US009873028B2

(12) United States Patent
Franklin et al.

(10) Patent No.: US 9,873,028 B2
(45) Date of Patent: Jan. 23, 2018

(54) GOLF CLUBS AND GOLF CLUB HEADS

(71) Applicant: Nike, Inc., Beaverton, OR (US)

(72) Inventors: David N. Franklin, Granbury, TX (US); Jason Cardani, Portland, OR (US); Andrew G. V. Oldknow, Beaverton, OR (US); Raymond J. Sander, Benbrook, TX (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/290,743

(22) Filed: May 29, 2014

(65) Prior Publication Data

US 2015/0343277 A1 Dec. 3, 2015

Related U.S. Application Data

(63) Continuation-in-part of application No. 13/308,079, filed on Nov. 30, 2011, now Pat. No. 9,072,948.

(51) Int. Cl.
*A63B 53/04* (2015.01)
*A63B 53/02* (2015.01)
(Continued)

(52) U.S. Cl.
CPC ..... *A63B 53/02* (2013.01); *A63B 53/047* (2013.01); *A63B 53/06* (2013.01); *A63B 60/54* (2015.10); *A63B 60/50* (2015.10); *A63B 2053/026* (2013.01); *A63B 2053/0416* (2013.01); *A63B 2053/0425* (2013.01);
(Continued)

(58) Field of Classification Search
USPC ..... 473/324–350, 244–247
See application file for complete search history.

(56) References Cited

U.S. PATENT DOCUMENTS 537,927 A * 4/1895 Kennedy ..... A63B 60/54 473/520
546,540 A * 9/1895 Kennedy ..... A63B 60/54 29/516
(Continued)

FOREIGN PATENT DOCUMENTS

FR 2672226 A1 8/1992
GB 2280380 A 2/1995
(Continued)

OTHER PUBLICATIONS

Oct. 28, 2015—(WO) International Searh Report and Written Opinion—App PCT/US2015/033371.
(Continued)

*Primary Examiner* — Alvin Hunter
(74) *Attorney, Agent, or Firm* — Banner & Witcoff, Ltd.

(57) ABSTRACT

Golf club heads include a golf club head body, a ball striking face, and a shaft engaging member configured to engage a golf club shaft with the golf club head body. Additionally, the shaft engaging member may be configured to engage the golf club head body and the shaft below a center of gravity of the golf club head, and/or the shaft engaging member may have rotational locking structure that can be locked in a plurality of positions. Further, the golf club head may include a face member and a rear member, where the rear member is configured to transfer energy and/or momentum to the face member, particularly on off-center hits.

25 Claims, 20 Drawing Sheets

(51) Int. Cl.
*A63B 53/06* (2015.01)
*A63B 60/54* (2015.01)
*A63B 60/50* (2015.01)

(52) U.S. Cl.
CPC ..... *A63B 2053/0454* (2013.01); *A63B 2053/0462* (2013.01); *A63B 2053/0491* (2013.01)

(56) References Cited

U.S. PATENT DOCUMENTS 569,438 A 10/1896 Urquhart
651,920 A 6/1900 Cushing, Jr.
1,058,463 A 4/1913 Pringle
1,083,434 A 1/1914 Curry
1,135,621 A 4/1915 Roberts
1,137,457 A 4/1915 Breitenbaugh
1,190,589 A 7/1916 Rolfe
1,206,104 A 11/1916 Goodrich
1,206,105 A 11/1916 Goodrich
1,219,417 A * 3/1917 Vories ..... A63B 53/06 473/247
1,222,770 A * 4/1917 Kaye ..... A63B 69/3638 473/256
1,235,922 A 8/1917 Pittar
1,250,301 A 12/1917 Goodrich
1,258,212 A 3/1918 Goodrich
1,429,569 A * 9/1922 Craig ..... A63B 53/06 403/230
1,463,533 A 7/1923 Kurz, Jr.
1,509,733 A * 9/1924 Langford ..... A63B 60/54 473/520
1,529,959 A 3/1925 Martin
1,549,265 A 8/1925 Kaden
1,556,928 A 10/1925 Ganders
1,568,485 A * 1/1926 Turney ..... A63B 53/06 473/247
1,594,850 A * 8/1926 Perkins ..... A63B 53/06 473/247
1,818,359 A 8/1931 Samaras et al.
1,867,103 A * 7/1932 Schavoir ..... A63B 53/02 473/315
2,171,383 A 8/1939 Wettlaufer
2,217,338 A * 10/1940 Fuller ..... A63B 53/06 473/247
2,222,534 A 11/1940 Henry
2,305,270 A * 12/1942 Nilson ..... A63B 53/06 473/247
2,329,313 A * 9/1943 Winter ..... A63B 53/06 473/247
2,429,351 A * 10/1947 Fetterolf ..... A63B 53/04 473/329
2,451,262 A 10/1948 Watkins
2,455,150 A * 11/1948 Verderber ..... A63B 53/06 473/247
2,477,438 A 7/1949 Brouwer
2,503,506 A 4/1950 Miller
2,520,702 A * 8/1950 Verderber ..... A63B 53/06 473/247
2,571,970 A * 10/1951 Verderber ..... A63B 53/06 116/315
2,593,368 A * 4/1952 Verderber ..... A63B 53/06 403/274
2,705,147 A 3/1955 Winter
2,777,694 A * 1/1957 Winter ..... A63B 53/06 473/247
3,214,169 A * 10/1965 Rupnow ..... A63B 53/06 473/246
3,305,235 A * 2/1967 Williams, Jr. ..... A63B 53/06 403/371
3,477,720 A 11/1969 Saba
3,516,674 A 6/1970 Scarborough
3,519,271 A * 7/1970 Smith ..... A63B 53/02 473/305
3,601,399 A * 8/1971 Agens ..... A63B 53/06 473/247
3,791,647 A * 2/1974 Verderber ..... A63B 53/06 473/247
3,840,231 A * 10/1974 Moore ..... A63B 53/06 473/245
3,980,301 A * 9/1976 Smith ..... A63B 53/02 473/314
4,121,832 A 10/1978 Ebbing
4,534,558 A 8/1985 Yoneyama
4,582,321 A 4/1986 Yoneyama
4,632,400 A * 12/1986 Boone ..... A63B 53/04 473/305
4,664,383 A 5/1987 Aizawa
4,667,963 A 5/1987 Yoneyama
4,697,814 A 10/1987 Yamada
4,708,347 A 11/1987 Kobayashi
4,728,105 A 3/1988 Kobayashi
4,792,140 A * 12/1988 Yamaguchi ..... A63B 53/04 273/DIG. 1
4,842,280 A 6/1989 Hilton
4,878,666 A * 11/1989 Hosoda ..... A63B 53/06 473/247
4,884,808 A 12/1989 Retzer
4,927,144 A * 5/1990 Stormon ..... A63B 53/02 473/313
4,928,972 A * 5/1990 Nakanishi ..... A63B 53/04 473/332
4,984,800 A 1/1991 Hamada
5,004,242 A 4/1991 Iwanaga et al.
5,009,425 A 4/1991 Okumoto et al.
5,078,397 A 1/1992 Aizawa
5,133,553 A 7/1992 Divnick
5,154,425 A * 10/1992 Niskanen ..... A63B 53/04 473/342
5,183,255 A * 2/1993 Antonious ..... A63B 53/02 273/271
5,228,689 A 7/1993 Donofrio, Sr.
5,228,694 A 7/1993 Okumoto et al.
5,253,869 A 10/1993 Dingle et al.
5,269,517 A 12/1993 Petruccelli et al.
5,275,413 A 1/1994 Sprague
5,290,036 A * 3/1994 Fenton ..... A63B 53/04 273/DIG. 8
5,292,123 A * 3/1994 Schmidt, Jr. ..... A63B 53/02 473/248
5,299,807 A * 4/1994 Hutin ..... A63B 53/04 473/329
5,326,106 A 7/1994 Meyer
5,333,871 A 8/1994 Wishon
5,344,151 A 9/1994 Anderson et al.
5,346,213 A * 9/1994 Yamada ..... A63B 53/04 473/329
5,390,920 A 2/1995 Nickum
5,393,056 A * 2/1995 Richardson ..... A63B 53/06 473/247
5,398,929 A * 3/1995 Kitaichi ..... A63B 53/04 473/329
5,413,337 A * 5/1995 Goodman ..... A63B 53/06 473/247
5,419,560 A 5/1995 Bamber
5,429,356 A 7/1995 Dingle et al.
5,433,441 A * 7/1995 Olsen ..... A63B 53/0487 473/328
5,435,551 A * 7/1995 Chen ..... A63B 53/04 473/314
5,447,307 A * 9/1995 Antonious ..... A63B 53/02 473/350
5,472,201 A * 12/1995 Aizawa ..... A63B 53/04 473/329
5,516,097 A * 5/1996 Huddleston ..... A63B 59/50 473/457
5,518,243 A 5/1996 Redman
D375,130 S * 10/1996 Hlinka ..... D21/752
5,601,498 A * 2/1997 Antonious ..... A63B 53/02 473/305

(56) References Cited

U.S. PATENT DOCUMENTS 5,611,740 A * 3/1997 Nagamoto ..... A63B 53/02 473/305
D378,770 S * 4/1997 Hlinka ..... D21/745
5,632,695 A * 5/1997 Hlinka ..... A63B 53/02 473/305
5,674,132 A * 10/1997 Fisher ..... A63B 53/04 273/DIG. 8
5,676,606 A 10/1997 Schaeffer et al.
5,692,972 A 12/1997 Langslet
5,695,409 A 12/1997 Jackson
5,716,290 A 2/1998 Baker et al.
5,755,625 A * 5/1998 Jackson ..... A63B 53/007 473/313
5,772,525 A 6/1998 Klein
5,772,526 A * 6/1998 Hano ..... A63B 53/04 473/314
5,803,825 A 9/1998 Hamilton
5,820,481 A 10/1998 Raudman
5,851,157 A * 12/1998 Koide ..... A63B 53/02 473/305
5,863,257 A 1/1999 Busnardo
5,928,087 A 7/1999 Emberton et al.
5,931,741 A * 8/1999 Fenton, Jr. ..... A63B 53/02 473/305
5,993,324 A 11/1999 Gammil
6,001,028 A * 12/1999 Tang ..... A63B 53/0487 473/313
6,001,030 A 12/1999 Delaney
6,080,068 A * 6/2000 Takeda ..... A63B 53/04 473/305
6,095,931 A * 8/2000 Hettinger ..... A63B 53/0487 473/341
6,117,022 A 9/2000 Crawford et al.
6,159,109 A 12/2000 Langslet
6,171,204 B1 * 1/2001 Starry ..... A63B 53/06 473/256
6,176,791 B1 1/2001 Wright
6,206,788 B1 * 3/2001 Krenzler ..... A63B 53/02 473/245
6,217,461 B1 4/2001 Galy
6,270,423 B1 * 8/2001 Webb ..... A63B 53/0487 473/226
6,299,546 B1 * 10/2001 Wang ..... A63B 53/02 473/314
6,302,807 B1 * 10/2001 Rohrer ..... A63B 53/0487 473/329
6,328,661 B1 12/2001 Helmstetter et al.
6,332,848 B1 12/2001 Long et al.
6,348,009 B1 * 2/2002 Dischler ..... A63B 53/02 473/247
6,428,423 B1 * 8/2002 Merko ..... A63B 53/02 473/307
6,431,997 B1 8/2002 Rohrer
6,443,857 B1 * 9/2002 Chuang ..... A63B 53/04 473/332
6,478,690 B2 * 11/2002 Helmstetter ..... A63B 53/0487 473/324
6,506,126 B1 1/2003 Goodman
6,514,155 B1 * 2/2003 Sheets ..... A63B 53/02 473/314
6,533,679 B1 3/2003 McCabe et al.
6,558,271 B1 5/2003 Beach et al.
6,625,848 B1 * 9/2003 Schneider ..... A01B 1/02 16/436
6,676,533 B1 * 1/2004 Hsien ..... A63B 53/02 473/247
6,743,112 B2 6/2004 Nelson
6,811,496 B2 11/2004 Wahl et al.
6,899,636 B2 5/2005 Finn
6,923,733 B2 8/2005 Chen
6,964,617 B2 11/2005 Williams
7,025,692 B2 * 4/2006 Erickson ..... A63B 53/0466 473/335
7,048,646 B2 * 5/2006 Yamanaka ..... A63B 53/0487 473/332
7,070,513 B2 * 7/2006 Takeda ..... A63B 53/04 473/329
7,090,590 B2 8/2006 Chen
7,128,663 B2 10/2006 Bamber
7,281,985 B2 * 10/2007 Galloway ..... A63B 53/02 473/246
7,297,071 B2 11/2007 Hyman
7,419,439 B1 * 9/2008 Aleamoni ..... A63B 53/0487 473/251
7,431,662 B2 10/2008 Tucker, Sr. et al.
7,452,283 B2 11/2008 Hettinger et al.
7,473,186 B2 * 1/2009 Best ..... A63B 53/0487 473/329
7,540,810 B2 * 6/2009 Hettinger ..... A63B 53/0487 473/331
7,566,276 B2 7/2009 Billings
7,575,523 B2 8/2009 Yokota
7,588,503 B2 9/2009 Roach et al.
7,601,077 B2 10/2009 Serrano et al.
7,651,409 B1 * 1/2010 Mier ..... A63B 53/007 473/330
7,677,987 B2 3/2010 Hilton
D613,357 S * 4/2010 Utz ..... D21/736
7,717,807 B2 5/2010 Evans et al.
7,740,545 B2 6/2010 Cameron
7,753,809 B2 7/2010 Cackett et al.
7,794,334 B2 9/2010 Hilton
7,934,999 B2 * 5/2011 Cackett ..... A63B 53/0466 473/242
7,938,739 B2 5/2011 Cole et al.
7,997,999 B2 * 8/2011 Roach ..... A63B 53/047 473/332
8,007,371 B2 8/2011 Breier et al.
8,070,622 B2 12/2011 Schmidt
8,092,318 B2 1/2012 Oldknow et al.
8,133,128 B2 3/2012 Boyd et al.
8,157,673 B2 4/2012 Gilbert et al.
8,177,664 B2 * 5/2012 Horii ..... A63B 53/0487 473/340
8,206,241 B2 * 6/2012 Boyd ..... A63B 53/0466 473/332
8,333,668 B2 * 12/2012 De La Cruz ..... A63B 53/0466 473/345
8,382,604 B2 * 2/2013 Billings ..... A63B 53/0487 473/244
8,517,851 B2 * 8/2013 Cackett ..... A63B 53/0466 473/242
8,523,698 B2 9/2013 Hotaling et al.
8,535,171 B2 * 9/2013 McGinnis, Jr. ..... A63B 53/02 473/305
8,734,265 B2 5/2014 Soracco
8,771,098 B2 * 7/2014 Hilton ..... A63B 53/08 473/251
8,900,064 B2 12/2014 Franklin
8,979,668 B2 3/2015 Nakamura
9,033,817 B2 5/2015 Snyder
9,072,948 B2 * 7/2015 Franklin ..... A63B 59/0092
9,089,747 B2 * 7/2015 Boyd ..... A63B 53/0466
9,089,749 B2 7/2015 Burnett et al.
9,101,805 B2 * 8/2015 Stites ..... A63B 53/02
9,101,808 B2 * 8/2015 Stites ..... A63B 53/0466
2002/0025859 A1 2/2002 Finn
2002/0169036 A1 11/2002 Boone
2004/0018886 A1 1/2004 Burrows
2005/0049078 A1 3/2005 Yamanaka et al.
2006/0148585 A1 7/2006 Vinton
2006/0183564 A1 8/2006 Park
2007/0142123 A1 6/2007 Franklin
2007/0259735 A1 11/2007 Beckman
2008/0009360 A1 * 1/2008 Purtill ..... A63B 53/00 473/244
2010/0167836 A1 7/2010 Horii et al.
2010/0184527 A1 7/2010 Demkowski et al.
2010/0261546 A1 10/2010 Nicodem
2011/0021287 A1 1/2011 Tucker, Sr. et al.
2011/0034270 A1 2/2011 Wahl et al.

(56) References Cited

U.S. PATENT DOCUMENTS

| | | | |
|---|---|---|---|
| 2012/0077615 | A1 | 3/2012 | Schmidt |
| 2012/0122607 | A1 | 5/2012 | Reinberg |
| 2013/0157774 | A1 | 6/2013 | Chen |
| 2013/0178307 | A1 | 7/2013 | Wicketts |
| 2013/0203522 | A1 | 8/2013 | Franklin et al. |
| 2013/0324284 | A1 | 12/2013 | Stites et al. |
| 2015/0080147 | A1 | 3/2015 | Cameron |
| 2015/0335966 | A1 | 11/2015 | Cameron |
| 2016/0129320 | A1 | 5/2016 | Dolezel et al. |
| 2016/0129321 | A1 | 5/2016 | Dolezel |

FOREIGN PATENT DOCUMENTS

| | | | | | |
|---|---|---|---|---|---|
| GB | 2374539 | A | * | 10/2002 | ..... A63B 53/02 |
| JP | H07031698 | A | | 2/1995 | |
| JP | 09000666 | A | * | 1/1997 | |
| JP | H09-000666 | | | 1/1997 | |
| JP | H09117537 | A | | 5/1997 | |
| JP | 09215785 | A | * | 8/1997 | |
| JP | 09276455 | A | * | 10/1997 | |
| JP | H09276455 | A | | 10/1997 | |
| JP | H10076031 | A | | 3/1998 | |
| JP | H10127836 | A | | 5/1998 | |
| JP | 11057082 | A | * | 3/1999 | |
| JP | 11137731 | A | * | 5/1999 | |
| JP | 11169493 | A | * | 6/1999 | |
| JP | H11169493 | A | | 6/1999 | |
| JP | 11244431 | A | * | 9/1999 | |
| JP | H11244431 | A | | 9/1999 | |
| JP | 2000126337 | A | | 5/2000 | |
| JP | 2001054599 | A | | 2/2001 | |
| JP | 2004141350 | A | | 5/2004 | |
| JP | 2004201879 | A | | 7/2004 | |
| JP | 2004351096 | A | | 12/2004 | |
| JP | 2005131280 | A | * | 5/2005 | |
| JP | 2005211613 | A | | 8/2005 | |
| JP | 2005305178 | A | * | 11/2005 | |
| JP | 2005342215 | A | | 12/2005 | |
| JP | 2006000435 | A | * | 1/2006 | |
| JP | 2006333876 | A | | 12/2006 | |
| JP | 2007330335 | A | | 12/2007 | |
| JP | 2010148565 | A | | 7/2010 | |
| JP | 2010154887 | A | * | 7/2010 | |
| JP | 2011004849 | A | | 1/2011 | |
| JP | 2011114112 | A | | 6/2011 | |
| JP | 2011224366 | A | | 11/2011 | |
| WO | 9709095 | A1 | | 3/1997 | |
| WO | 9920358 | A1 | | 4/1999 | |
| WO | WO 9920358 | A1 | * | 4/1999 | ..... A63B 53/04 |
| WO | 2009035345 | A1 | | 3/2009 | |
| WO | 2013082277 | A1 | | 6/2013 | |

OTHER PUBLICATIONS

Sep. 28, 2015—(WO) International Search Report and Written Opinion—App PCT/US2015/032819.
Jul. 12, 2016—(WO) ISR & WO—App. No. PCT/US15/032821.
Aug. 8, 2015—(WO) ISR & WO—App. No. PCT/US15/033362.

* cited by examiner

GOLF CLUBS AND GOLF CLUB HEADS

CROSS REFERENCE TO RELATED APPLICATION

This application claims priority to, and is a continuation-in-part of, co-pending U.S. patent application Ser. No. 13/308,079, filed Nov. 30, 2011.

FIELD OF THE DISCLOSURE

The present disclosure relates to golf clubs and golf club heads. Particular example aspects of this disclosure relate to the configuration of golf club heads.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well-known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.). Still other advancements have sought to provide golf club constructions that provide improved feel to the golfer or enhanced energy transfer from the golf club to the golf ball.

While the industry has witnessed dramatic changes and improvements to golf equipment in recent years, there is room in the art for further advances in golf club technology. The present invention seeks to address certain of the shortcomings of prior golf club designs and to provide a design having advantages to heretofore provided.

BRIEF SUMMARY

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Aspects of this disclosure relate to ball striking devices, such as iron-type golf club heads and iron-type golf clubs. Iron-type golf club heads according to at least some example aspects of this disclosure may include: a golf club head body, a ball striking face, and a shaft engaging member which is configured to engage the golf club head body with a golf club shaft. According to aspects of the disclosure, the golf club head body and the shaft engaging member may be configured so as to engage with each other. Further, according to aspects of the disclosure, the golf club head may be configured to provide the connection between the golf club head body and the shaft connecting member wherein the connection is below the center of gravity of the golf club head and/or the center of gravity of the golf club head body. Additionally, according to aspects of the disclosure, the golf club head may be configured so as to provide the connection between the golf club head body and the shaft connecting member below the center of the ball striking face of the golf club head or below other preferred impact positions between the golf ball and the ball striking face of the golf club head.

According to aspects of this disclosure, the iron-type golf club head body and the shaft engaging member may be integrally formed and/or separate parts configured to engage with each other. Further, according to aspects of the disclosure, the iron-type golf club head body and the shaft engaging member may be configured to provide a connection between the iron-type golf club head body and the shaft engaging member, wherein the entire connection is completely below the center of gravity of the iron-type golf club head and/or the center of gravity of the iron-type golf club head body. Additionally, according to aspects of the disclosure, the iron-type golf club head body and the shaft engaging member may be configured to provide the entire connection between the iron-type golf club head body and the shaft connecting member completely below the center of the ball striking face of the iron-type golf club head or completely below other preferred impact positions between the golf ball and the ball striking face of the iron-type golf club head.

According to further aspects of the disclosure, golf club heads as described herein may be configured to have rotational locking structure that is configured to permit connection of the shaft engaging member to the club head body in at least first and second different rotational positions (i.e., a plurality of different positions) with respect to each other. The club head body may further be configured so that the loft angle of the club head is different in each different rotational position. Various structures may be used for achieving different rotational positions, such as by using interlocking gear teeth or other complementary engaging structures.

According to still further aspects of the disclosure, golf club heads as described herein may include a face member including the face having a striking surface configured for striking a ball and a rear side opposite the striking surface of the face, a rear member joined to the rear side of the face member, the rear member having a heel edge and a toe edge, and one or more connection members connecting the rear side of the face member to the rear member, such that a space is defined between the face member and the rear member. Such golf club heads may include a resilient member separating the rear member from the rear side of the face member, wherein the resilient member engages the rear member and the rear side of the face member and is configured to transfer momentum between the face member and the rear member.

According to still further aspects of the disclosure, golf club heads as described herein may include a face member including the face having a striking surface configured for striking a ball and a rear side opposite the striking surface of the face, a rear member joined to the rear side of the face member, the rear member having a heel edge and a toe edge, and one or more engagement members forming one or more points of rigid engagement between the rear side of the face member and the rear member, such that a space is defined between the face member and the rear member. Such golf club heads may include a resilient member separating the rear member from the rear side of the face member, wherein the resilient member engages the rear member and the rear side of the face member and is configured to transfer momentum between the face member and the rear member. The engagement member(s) may form the sole or only point(s) of rigid engagement between the face member and the rear member.

Further, it is noted that, according to aspects of the disclosure, the golf club head body and the shaft engaging member may be separate pieces configured to engage with each other. Additionally, according to other aspects of the disclosure, the iron-type or wood-type golf club head body and the shaft engaging member may be integrally formed as a unitary, one-piece construction.

Other aspects of this disclosure may relate to wood-type golf club heads, putter heads, or other types of golf club heads. Such other types of golf club heads may include any features described herein with respect to iron-type club heads.

Additional aspects of this disclosure relate to golf club structures, including iron-type, wood-type, putter-type, and other golf club structures that include golf club heads, e.g., of the types described above. Such golf club structures further may include one or more of: a shaft attached to the club head (optionally via a separate shaft engaging member or a shaft engaging member provided as an integral part of one or more of the club head or shaft); a grip or handle attached to the shaft member; additional weight members; etc.

Still additional aspects of this disclosure relate to methods for producing golf club heads and golf club structures, e.g., of the types described above. Such methods may include, for example: (a) providing a golf club head of the various types described above (including any or all of the various structures, features, and/or arrangements described above), e.g., by manufacturing or otherwise constructing the golf club head, by obtaining the golf club head from another source, etc.; and (b) engaging the shaft with the golf club head (e.g., via the shaft connecting member). Other steps also may be included in these methods, such as engaging a grip with the shaft, connecting the face member to the rear member, club head body finishing steps, etc.

Given the general description of various example aspects of the disclosure provided above, more detailed descriptions of various specific examples of golf clubs and golf club head structures according to the disclosure are provided below.

BRIEF DESCRIPTION OF THE DRAWINGS

The present disclosure is illustrated by way of example and not limited in the accompanying figures, in which like reference numerals indicate similar elements throughout, and in which.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-23.

Figure 1:
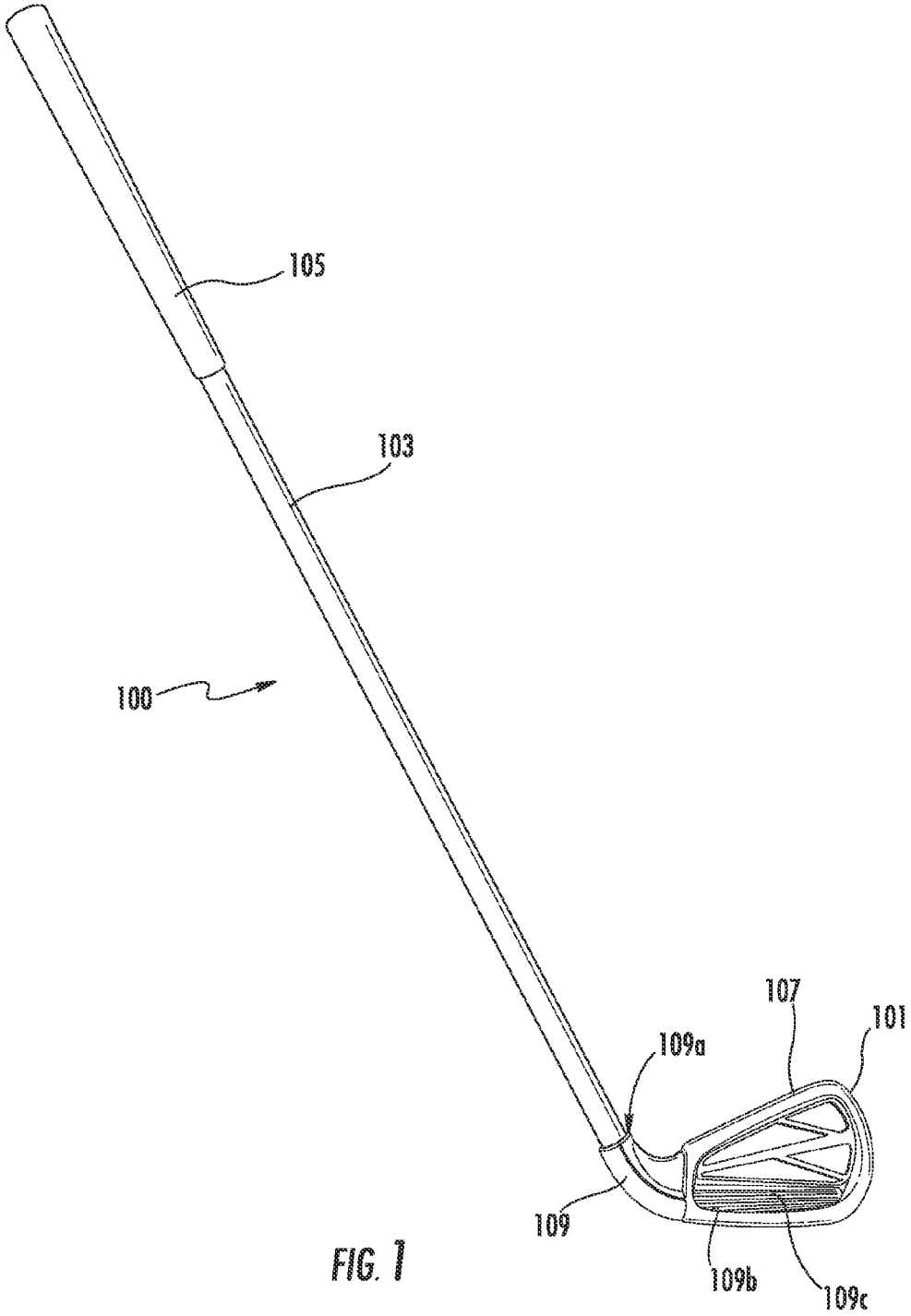
FIG. 1 is a rear view of an illustrative embodiment of an iron-type golf club according to aspects of the disclosure.

FIG. 1 generally illustrates an example of an iron-type golf club 100 according to aspects of the disclosure. As seen in FIG. 1, the iron-type golf club may include an iron-type golf club head 101 in accordance with the present disclosure.

In addition to the golf club head 101, the overall golf club structure 100 may include a shaft 103 and a grip or handle 105 attached to the shaft 103. The shaft 103 may be received in, engaged with, and/or attached to the golf club head 101, for example, through a shaft-receiving sleeve or element extending into the club head 101 (e.g., the shaft engaging member 109 discussed below), via a hosel (e.g., a hosel included in the shaft engaging member discussed below), and/or in other manners as will be described in more detail below. The connections may be via adhesives, cements, welding, soldering, mechanical connectors (such as threads, retaining elements, or the like), etc. If desired, the shaft 103 may be connected to the golf club head 101 in a releasable and/or adjustable manner using mechanical connectors to allow easy interchange of one shaft for another on the head and/or adjustment of the shaft with respect to the head.

The shaft 103 may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle 105 may be attached to, engaged with, and/or extend from the shaft 103 in any suitable or desired manner, including in conventional manners known and used in the art, e.g., using adhesives or cements, mechanical connectors, etc. As another example, if desired, the grip or handle 105 may be integrally formed as a unitary, one-piece construction with the shaft 103. Additionally, any desired grip or handle materials may be used without departing from this disclosure, including, for example: rubber materials, leather materials, rubber or other materials including cord or other fabric material embedded therein, polymeric materials, and the like.

Figure 1A:
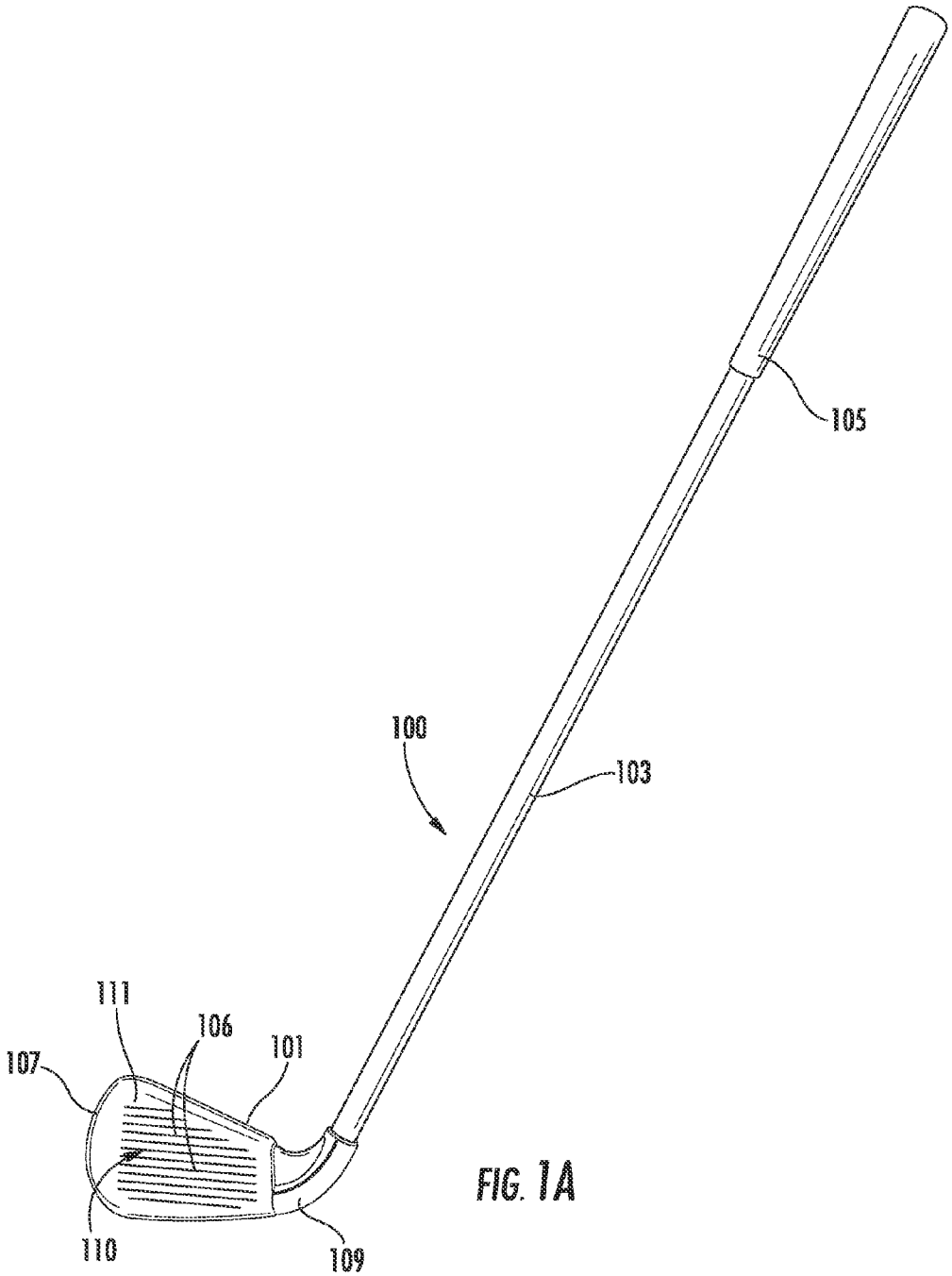
FIG. 1A is a front view of the head of the iron-type golf club shown in FIG. 1.

According to aspects of the disclosure, the golf club head 101 may include a golf club head body 107 and a shaft engaging member 109. Further, according to aspects of the disclosure, the golf club head body 101 may also include a ball striking face or striking face 111 that has a ball striking surface or striking surface 110 configured for striking a ball, as shown in FIG. 1A, as well as a rear surface 112 in one embodiment. According to aspects of the disclosure, the ball striking face 111 may have a generally trapezoidal shape which extends between a top and a sole of the golf club head body 107 and, further, extends substantially between a toe and a heel of the golf club head body 107. Of course, the ball striking face 111 may have other configurations as well. According to further aspects of the disclosure, the ball striking face 111 may be comprised of one or more materials. The material(s) of the ball striking face should be relatively durable to withstand the repeated impacts with the golf ball. As some more specific examples, the ball striking face 111 may comprise a high-strength steel, titanium, or other metals (including alloys).

Further, according to aspects of the disclosure, the ball striking face 111 may include one or more score lines or grooves 106 that extend generally horizontally across the ball striking face 111 (when the club is oriented in a ball address orientation). The grooves 106 may interact with the dimpled surface of the golf ball during the impact of the golf club head 101 with a golf ball (e.g., during a golf swing) and affect the aerodynamics of the golf ball during the golf shot. For example, the grooves 106 may cause a spin (e.g., back spin) of the golf ball during the golf shot.

Figure 2A:
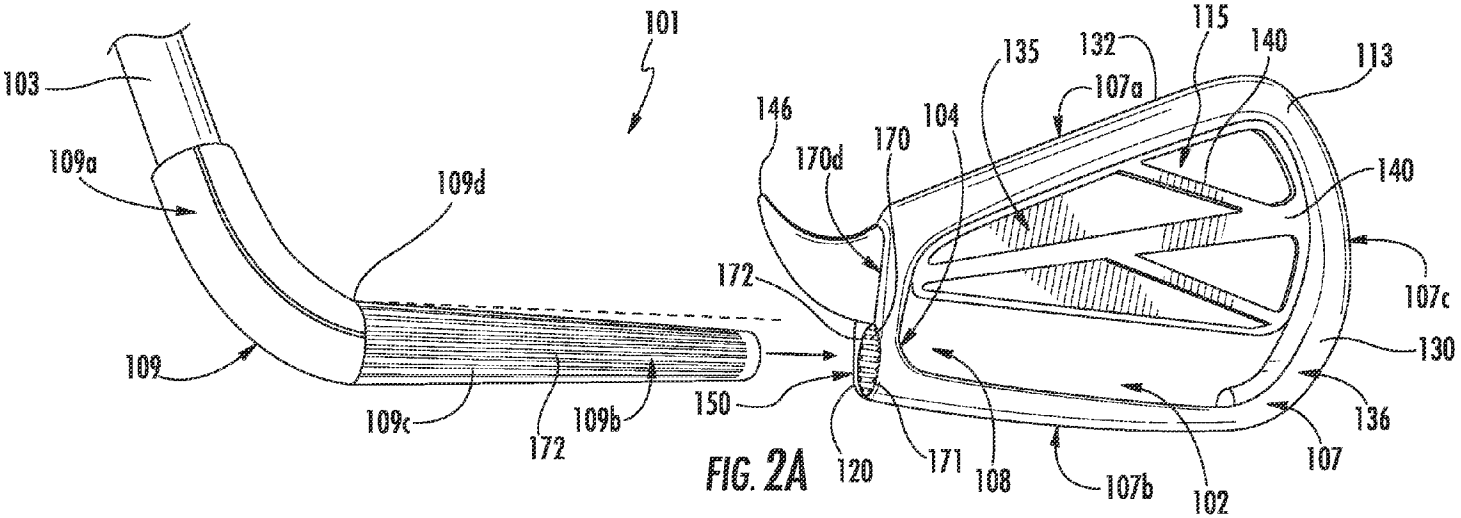
FIG. 2A is a partially exploded rear view of a head of the iron-type golf club shown in FIG. 1.

According to aspects of the disclosure, the golf club head body 107 may be a blade type iron golf club head, a perimeter weighted and/or cavity back type iron golf club head, a half cavity iron type golf club head, or other iron-type golf club head structure. According to aspects of the disclosure, the golf club head body 107 may include a top 107*a*, a sole 107*b*, a toe end 107*c*, and a heel end 107*d*. Further, as seen in FIGS. 1-3, according to aspects of the disclosure, the golf club head body 107 may be configured in a generally trapezoidal shape. According to aspects of the disclosure, at least a portion of the heel end 107*d* of the golf club head body 107 may be flat or substantially flat. For example, at least a portion of the heel end 107*d* of the golf club head body 107 may formed as a relatively flat surface that extends in a plane substantially perpendicular to the sole 107*b* of the golf club head body 107 (e.g., the heel end 107*d* may extend in a substantially vertical plane when the golf club head 101 is at the ball address position). Further, according to aspects of the disclosure, the heel end 107*d* may have a tapered configuration wherein the heel end 107*d* becomes narrower as it extends vertically upward from the sole 107*b*, such that the lower portion of the heel end 107*d* is wider than the upper portion of the heel end 107*d*.

In the embodiment shown in FIGS. 1-6, the face 111 is formed integrally as part of a unitary, one-piece construction with a face member 120 that is connected to a rear member 130. The face member 120 and/or the rear member 130 may each be made of an integral, unitary, one-piece construction in one embodiment, or the face member 120 and/or the rear member 130 may be made from a multi-piece construction in another embodiment. According to other examples, the ball striking face 111 may constitute a separate element, such as a face plate, which is configured to be engaged with the face member 120 and/or the rear member 130. For example, the face member 120 or the rear member 130 may include a structure, such as a recess, notch, frame or other configuration for receiving the face plate, and the face plate may be engaged in a variety of ways. For example, the face plate may be engaged with the face member 120 by press fitting; bonding with adhesives or cements; welding (e.g., laser welding), soldering, brazing, or other fusing techniques; mechanical connectors; etc.

The rear member 130 in the embodiment of FIGS. 1-6 is formed as a ring-shaped perimeter member 132 with a center opening 135. The perimeter member 132 at least partially forms and defines the perimeter weighting member 113 of the club head 101, and the center opening 135 at least partially defines the rear cavity 115 of the club head 101. The rear member 130 may have a different configuration in another embodiment. For example, the rear member 130 may have no opening 135 in one embodiment, creating a solid-body or blade-type club head. In another embodiment, the rear member 130 may have a rear wall extending from a sole portion of the perimeter member 132 into the center opening 135 and bridging a portion of the center opening 135, or may include a different type of bridge member or bridging structure that bridges the center opening 135.

The rear member 130 may have varying sizes and weights in different embodiments. For example, in one embodiment, the rear member 130 may make up about 25-70% of the total weight of the head 101. The rear member 130 may also have various different dimensions and structural properties in various embodiments. In the embodiment shown in FIGS. 1-3, the rear member 130 has a heel edge 133 and a toe edge 134, with a lateral width defined between the heel and toe edges 133, 134. The lateral width of the rear member 130 is the same or approximately the same as the lateral width of the face member 120, measured between the heel edge 123 and toe 124 of the face member 120. In one embodiment, the rear member 130 has its mass distributed proportionally more toward the heel and toe edges 133, 134, and has a thickness and a cross-sectional area that are greater at or around the heel and toe edges 133, 134 than at the CG of the rear member 130. Further, the rear member 130 may be positioned so that the CG of the rear member 130 is substantially aligned with the CG of the face member 120. In one embodiment, for example as shown in FIGS. 1-6, the CGs of the rear member 130 and the face member 120 are laterally aligned, and these respective CGs may additionally or alternately be vertically aligned in another embodiment. The face member 120 may likewise have various different sizes, weights, weight distributions, dimensions, and structural properties.

In other embodiments, the rear member 130 may be differently configured, and/or the head 101 may contain multiple rear members 130. For example, the rear member 130 as shown in FIGS. 1-6 may be divided into two, three, or more separate rear members 130 in another embodiment, which may be connected to the face member 120 in similar or different configurations. It is understood that the rear member 130 in all embodiments may affect or influence the center of gravity of the head 101. Additionally, the rear member 130 may be made of any of a variety of different materials, which may be selected based on their weight or density, and the rear member 130 may be configured to have a greater density than the face member 120 and/or to have areas of locally increased density in one embodiment. For example, the rear member 130 may be made from a metallic material such as stainless steel and/or tungsten, or may be made from other materials, for example polymers that may be doped with a heavier material (e.g. tungsten), or combinations of such materials. The rear member 130 may also include portions that may be more heavily weighted than others, and may include weighted inserts or other inserts, portions doped with dense materials, etc., for this purpose.

The body 107 formed by the face member 120 and the rear member 130 may have a number of different configurations. In one embodiment, the body 107 includes a perimeter weighting member 113 extending rearward from the peripheral edges 114 of the face 111 around at least a portion of the periphery of the body 107, such as in the embodiments shown in FIGS. 1-9. For example, the perimeter weighting member 113 may extend rearward at least along the sole 107*b* of the head 107. The perimeter weighting member 113 may further define, at least in part, a rear cavity 115 located behind the face 111. In the embodiment shown in FIGS. 1-6, the perimeter weighting member 113 extends rearwardly around the entire periphery of the body 107 and combines with the rear surface 112 of the face 111 to define a rear cavity 115. As shown in FIG. 6, the face member 120 may have a slight indent 121 in the rear surface 122 that defines a portion of the rear cavity 115. In another embodiment, the rear surface 122 of the face member 120 may be completely flat, and the rear member 130 may completely define the rear cavity 115 (if present). The body 107 also has connecting structure 150 for connection of a shaft engaging member 109, as described in greater detail below.

The face member 120 and the rear member 130 are connected to each other to form the body 107, as described herein. In the embodiment illustrated in FIGS. 1-6, the face member 120 and the rear member 130 have shapes and sizes that are substantially the same, at least around the top 107*a*, the toe side 107*c*, and the sole 107*b* of the head 101, as well as potentially the heel 107*d*. For example, the rear surface 121 of the face member 120 and the front surface 131 of the rear member 130 confront each other and have perimeter lengths that are equal or substantially equal (i.e., +/−5%). Additionally, in this embodiment, the face member 120 and the rear member 130 have peripheries that are flush or substantially flush with each other, to create a smooth outer profile. As used herein, "substantially flush" means that a surface of one article is level and aligned with the surface of an adjacent article, such that the two surfaces form a substantially flat single surface, within a tolerance of +/−0.005 inches.

Figure 7:
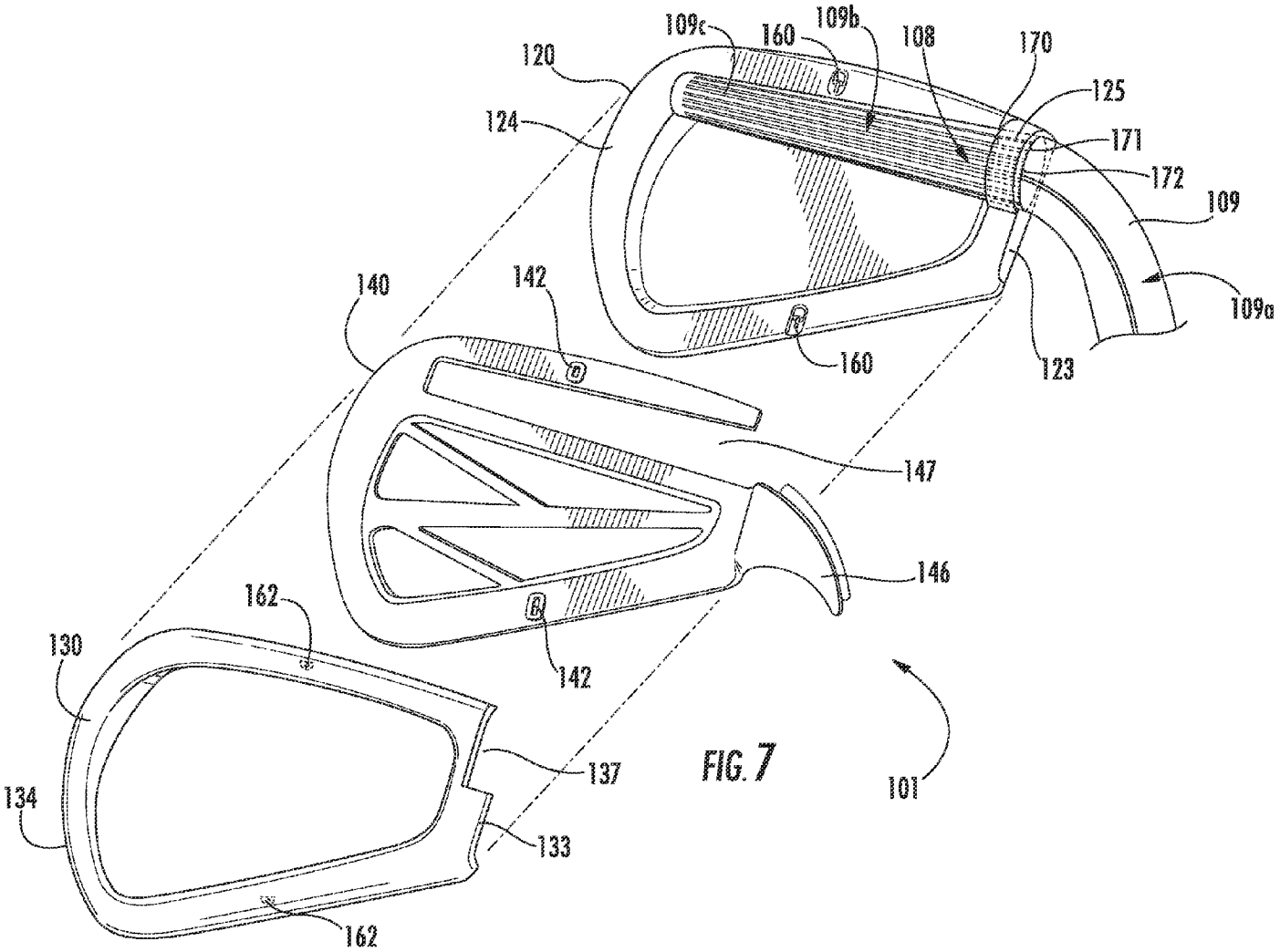
FIG. 7 is a rear exploded view of another illustrative embodiment of an iron-type golf club head according to aspects of the disclosure.
Figure 8:
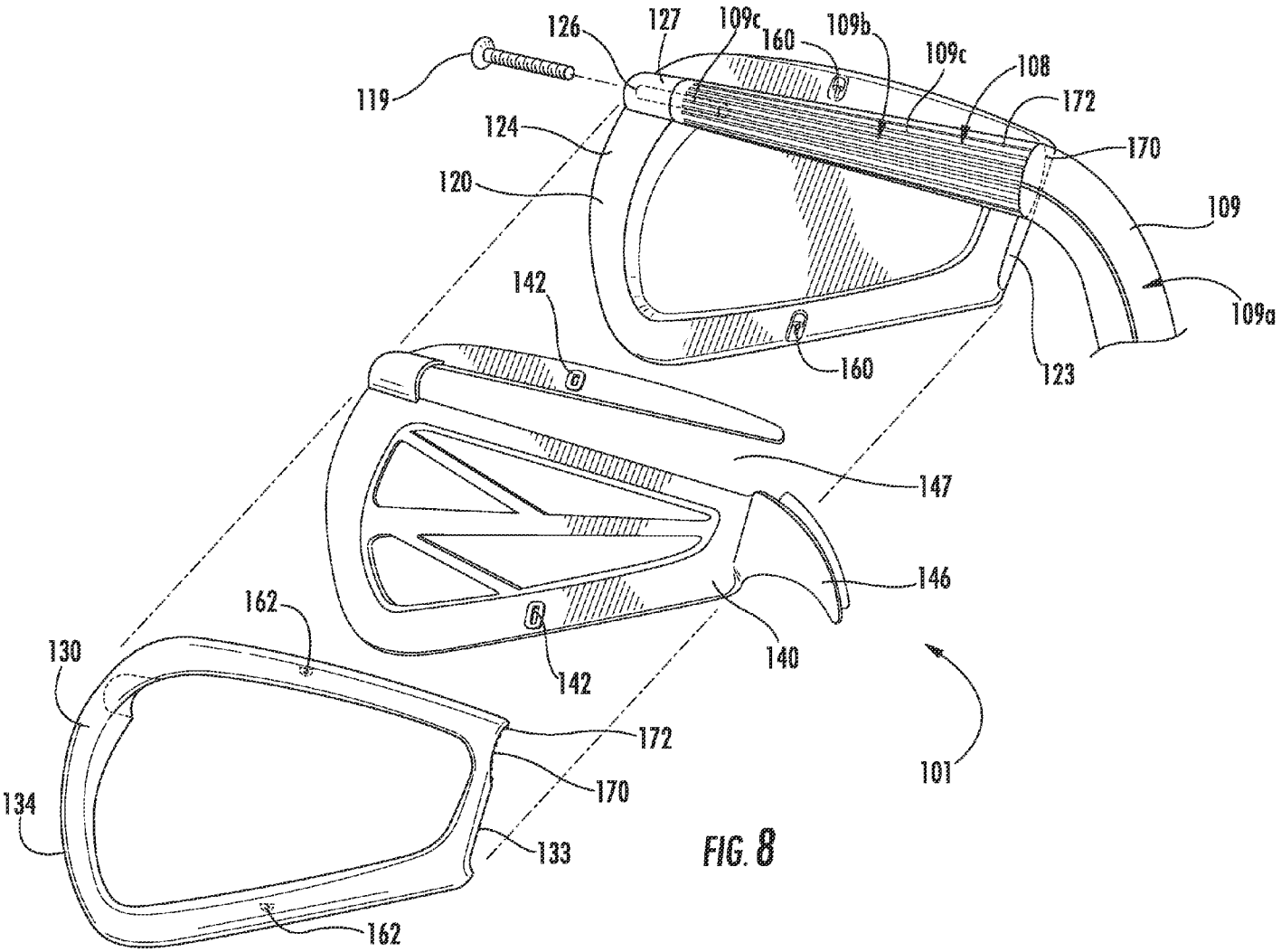
FIG. 8 is a rear exploded view of another illustrative embodiment of an iron-type golf club head according to aspects of the disclosure.
Figure 9:
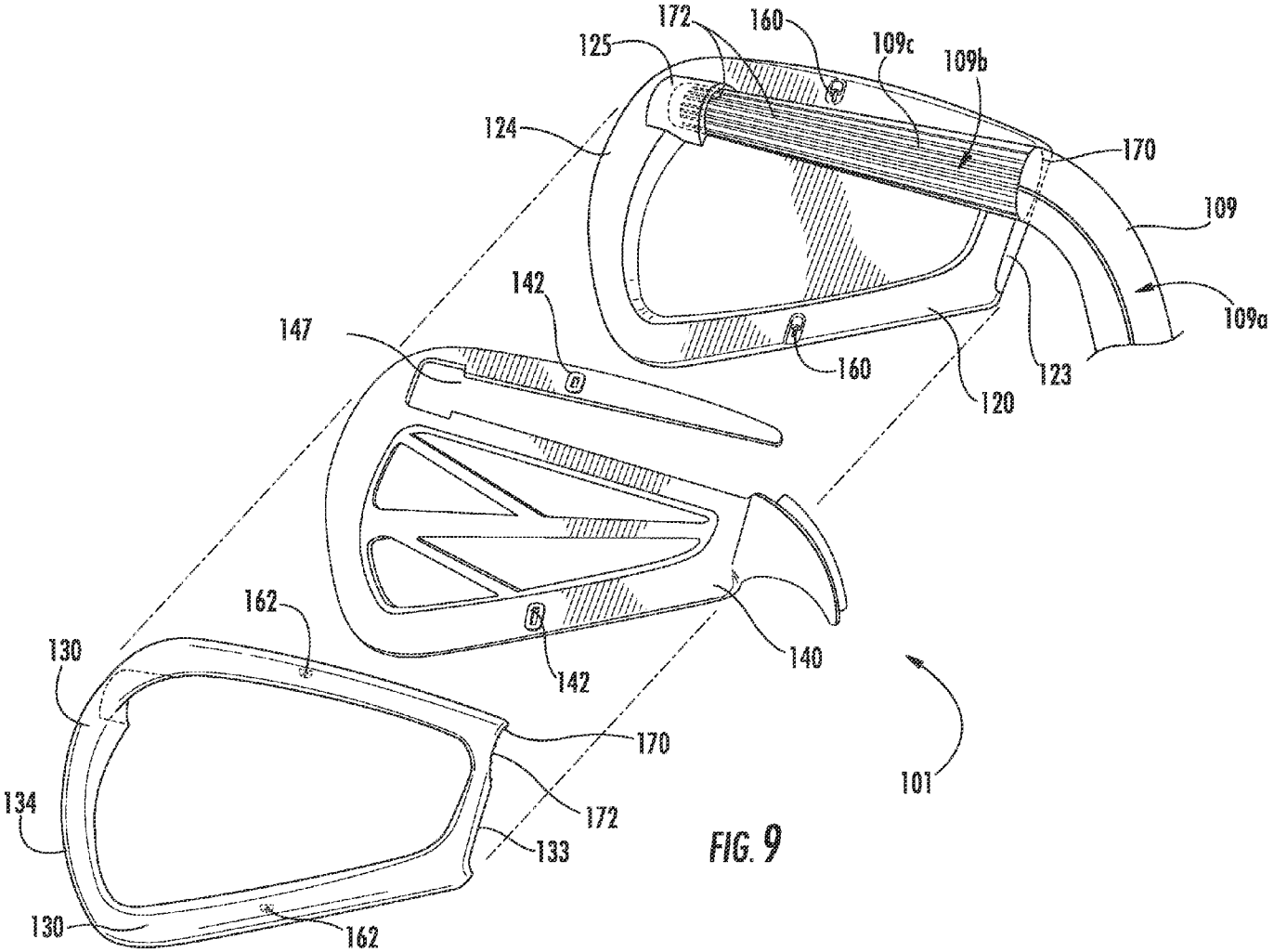
FIG. 9 is a rear exploded view of another illustrative embodiment of an iron-type golf club head according to aspects of the disclosure.
Figure 10:
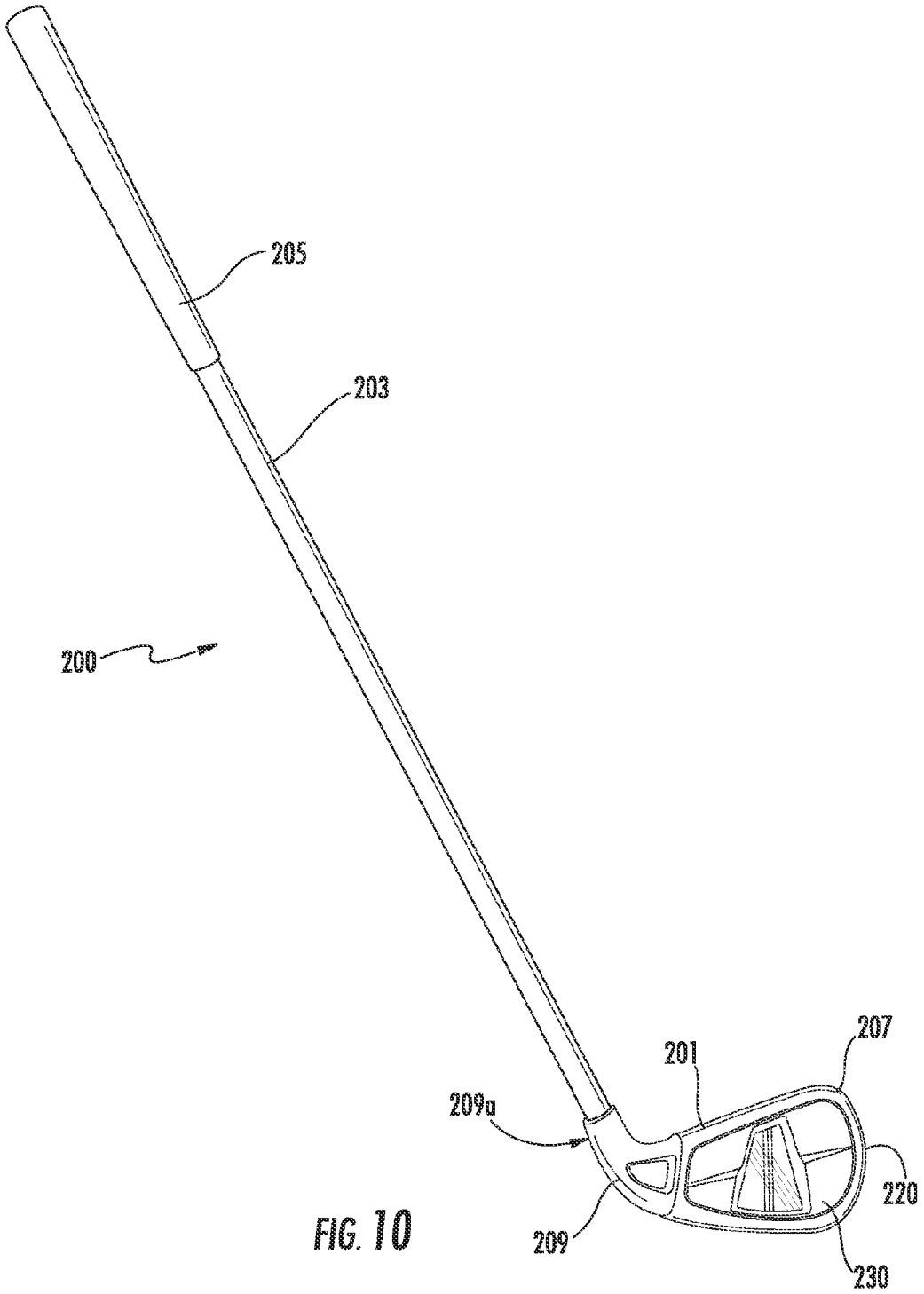
FIG. 10 is a rear view of another illustrative embodiment of an iron-type golf club according to aspects of the disclosure.
Figure 11A:
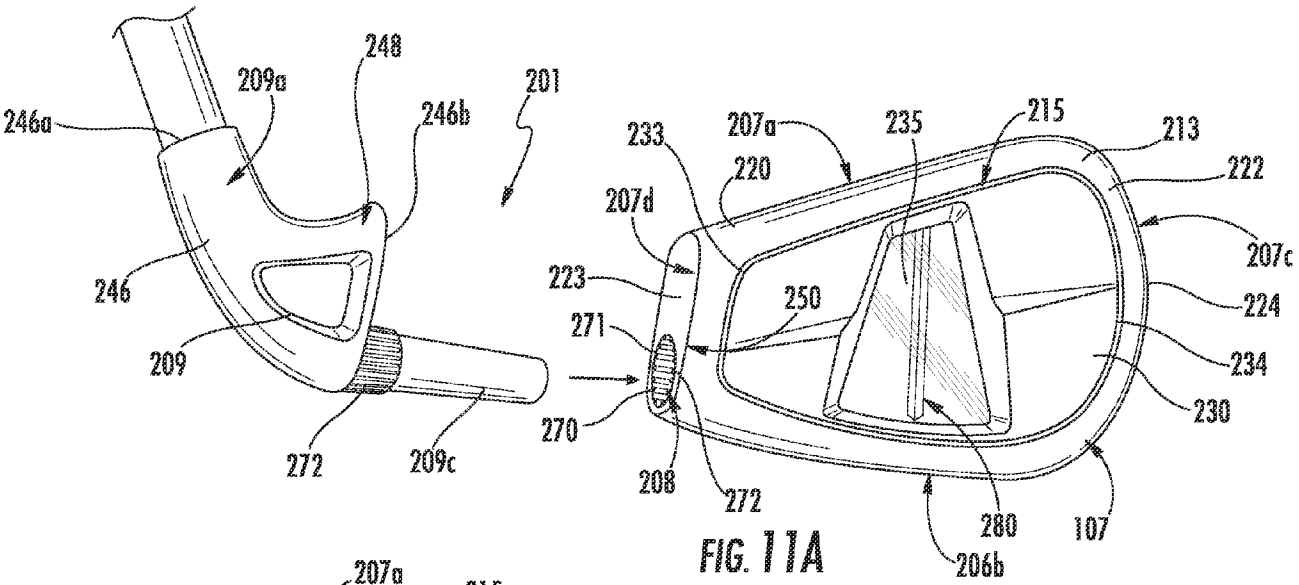
FIG. 11A is a partially exploded rear view of a head of the iron-type golf club shown in FIG. 10.
Figure 11B:
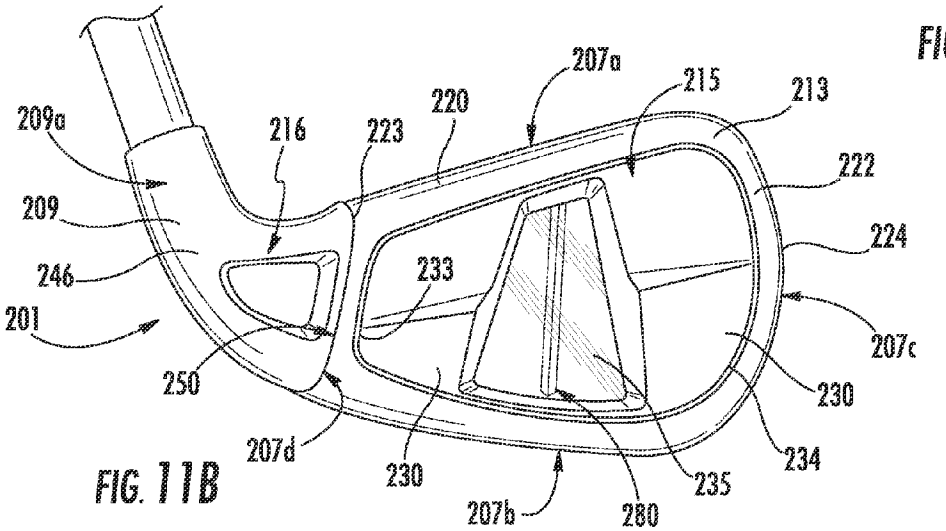
FIG. 11B is a rear view of the head of the iron-type golf club shown in FIG. 10.
Figure 12:
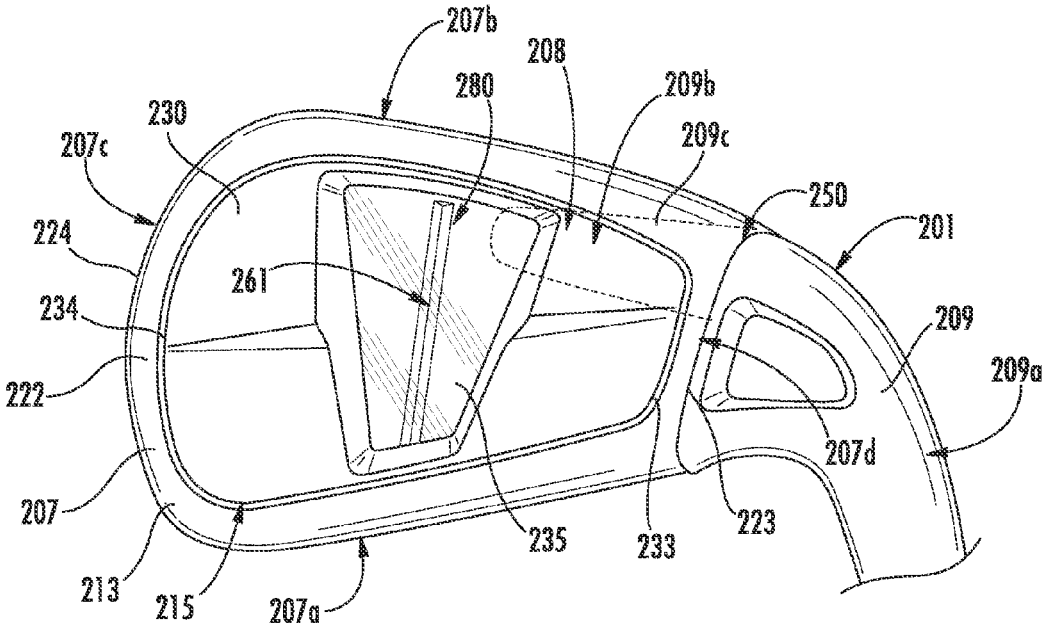
FIG. 12 is an enlarged rear view of the head of the iron-type golf club shown in FIG. 10, with internal structure shown in broken lines.

In one embodiment, the face member 120 and the rear member 130 are connected such that the rear member 130 is configured to transfer energy and/or momentum to the face member 120 upon impact of the ball on the striking surface 110, including on an off-center impact. The rear member 130 may be connected to the face member 120 in a number of different configurations that permit energy and/or momentum transfer between the rear member 130 and the face member 120, several of which are described below and shown in the FIGS. In the embodiment illustrated in FIGS. 1-6, the face member 120 is connected to the rear member 130 by complementary connection members that include one or more pin connections 160 that form a joint 161 between the face member 120 and the rear member 130, as described in greater detail herein. The embodiments in FIGS. 7-9 are constructed in similar manners, and the connection members of these embodiments is not described separately herein for the sake of brevity.

Figure 5:
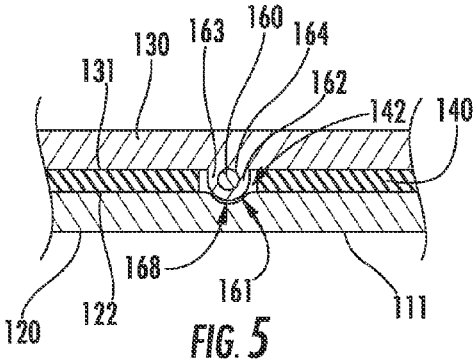
FIG. 5 is a cross-section view taken along lines 5-5 in FIG. 3.
Figure 6:
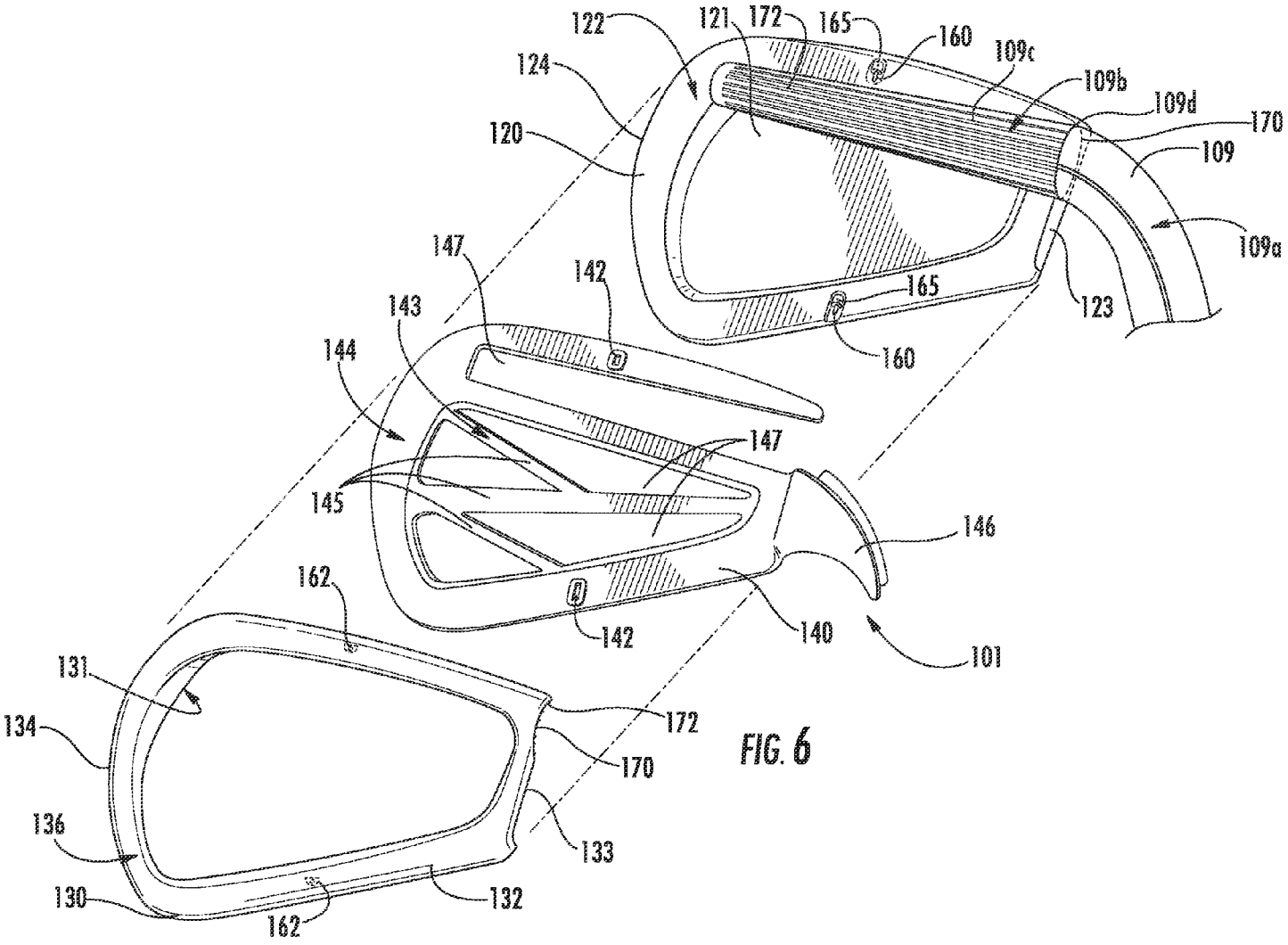
FIG. 6 is a rear exploded view of the head of the iron-type golf club shown in FIG. 1.

The connection members in the embodiment of FIGS. 1-6 include a pair of pin connections 160 positioned near the top and bottom of the rear surface 122 of the face member 120, and a pair of receivers 162 positioned on the front surface 131 of the rear member 130 and configured to engage and receive the pins 160 in a complementary manner. The pins 160 in the embodiment illustrated in FIGS. 1-6 extend vertically upward from bases 165 connected to the face member 120. The receivers 162 in this embodiment are in the form of tabs 163, each with an aperture 164 to receive the pins 160, as shown in FIG. 5. The pins 160 and the receivers 162, when connected, form a joint 161 that permits energy and/or momentum can be transferred between the rear member 130 and the face member 120 during impact, including an off-center impact on the striking surface 110. It is understood that a fastener (not shown) such as a nut, clamp, key, etc., or other retaining structure may be used to retain the pin 160 in connection with the receiver 162. The connection members (e.g., pins 160 and receivers 162) connect together at connection points 168 that are located between the heel and toe edges 123, 124 of the face member 120 and between the heel and toe edges 133, 134 of the rear member 130. As shown in FIGS. 3 and 6, the pins 160 and the connection points 168 are approximately vertically aligned with each other, and the pins 160 and the connection points 168 are also approximately vertically aligned with the CG of the face member 120. Likewise, the receivers 162 are approximately vertically aligned with each other and with the CG of the rear member 130. Further, the connection points 168 may be located approximately equidistant from the heel edge 123 and the toe edge 124 of the face member 120 and approximately equidistant from the heel edge 133 and the toe edge 134 of the rear member 130. The CG of the face member 120 and the CG of the rear member 130 may be aligned with each other at least in the lateral (heel-toe) direction in one embodiment.

In other embodiments, different types of connection members may be used, or an engagement member such as the engagement members 280 shown in FIGS. 10-15 and 22, to permit transfer of energy and/or momentum. In an alternate embodiment, the positions of at least some components of the connection members (e.g., the pins 160 and receivers 162) may be transposed between the face member 120 and the rear member 130. For example, one or both of the pins 160 may be located on the rear member 130 and one or both of the receivers 162 may be located on the face member 120. It is understood that the face member 120 and the rear member 130 may have diverse types of connection members. In a further embodiment, the head 101 may not utilize connection members or a joint 161 as described herein.

The connection members (e.g., the pins 160 and receivers 162) may form the only direct connection between the face member 120 and the rear member 130, such as in the embodiment of FIGS. 1-6. In this configuration, the rear member 130 may be spaced from the face member 120 between the connection members and the heel edges 123, 133 and between the connection members and the toe edges 124, 134. In one embodiment, the space between the rear member 130 and the face member 120 may be at least partially filled by another member, such as a resilient member 140 as described herein. In another embodiment, additional direct connections between the face member 120 and the rear member 130 may exist.

In the embodiment of FIGS. 1-6, the rear member 130 is connected to the face member 120 by a resilient member 140 at least partially formed of a resilient material. In this embodiment, the resilient member 140 is positioned in a space 141 between the rear member 130 and the face member 120 and engages both the front surface 131 of the rear member 130 and the rear surface 122 of the face member 120. In another embodiment, the resilient member 140 may form the only connection between the rear member 130 and the face member 120, and the rear member 130 may be considered to be suspended with respect to the face member 120 by the resilient member 140 in this configuration. One configuration of such an embodiment may appear identical to the embodiment of FIGS. 1-6, except with the pins 160, the receivers 162, and the slots 142 of the resilient member 140 being absent. It is understood that an adhesive or other bonding material may be utilized to connect the resilient member 140 to the face member 120 and/or the rear member 130, and that other connection techniques may be used in other embodiments, such as mechanical fasteners, interlocking designs (e.g. dovetail, tab and slot, etc.) and others. In one embodiment, the resilient member 140 includes slots 142 to allow the connection members (e.g., the pins 160 and/or the receivers 162) to engage each other through the resilient member 140. In the embodiment of FIGS. 1-6, the slots 142 are in the form of holes that are completely defined within the resilient member 140, however in other embodiments, the slots 142 may extend to one or more edges of the resilient member.

The resilient member 140 in the embodiment of FIGS. 1-6 has a center portion 143 that is at least partially open, such that the resilient member 140 is formed in a ring-like perimeter portion 144. In this configuration, the portions of the resilient member 140 positioned between the face member 120 and the rear member 130 are continuous, and the center portion 143 over the rear cavity 115 is open or at least partially open. The resilient member 140 illustrated in FIGS. 1-6 has a center portion 143 with a plurality of strips 145 bridging across the open center portion 143 from one point on the perimeter portion 144 to another. These strips 145 are exposed within the rear cavity 115. The resilient member 140 further has cut-out areas 147 configured to permit components of the head 101 to pass through the resilient member 140, such as the shaft engaging member 109. In another embodiment, the center portion 143 may be completely open or may have a different type of bridging structure (including incomplete bridging structures). In further embodiments, the center portion 143 may not have any open portion, and/or the perimeter portion 144 may be non-continuous and may only be intermittently present between the face and rear members 120, 130. It is understood that the configuration of the resilient member 140 may be at least partially dictated by the configurations of the face member 120 and/or the rear member 130.

The resilient material of the resilient member 140 may be a natural or synthetic rubber material, a polyurethane-based elastomer, a silicone material, or other elastomeric material in one embodiment, but may be a different type of resilient material in another embodiment, including various types of resilient polymers, such as foam materials or other rubber-like materials. In one embodiment, the resilient material 140 may be a thermoplastic (TPE) vulcanizate Additionally, the resilient member 140 may have at least some degree of resiliency, such that the resilient member 140 exerts a response force when compressed, and can return to its previous state following compression. The resilient member 140 may have a strength or hardness that is lower than, and may be significantly lower than, the strength/hardness of the material of the face member 120 and/or the rear member 130. In one embodiment, the resilient member 140 may have a hardness of from 70 Shore A to 70 Shore D. The hardness may be determined, for example, by using ASTM D-2240 or another applicable test with a Shore durometer. It is understood that the resilient member 140 may be made from any material described in U.S. Patent Application Publication No. 2013/0137533, filed Nov. 30, 2011, which application is incorporated by reference herein in its entirety and made part hereof.

The properties of the resilient material, such as hardness and/or resiliency, may be designed for use in a specific configuration. For example, the hardness and/or resiliency of the resilient member 140 may be designed to ensure that an appropriate rebound or reaction force is transferred to the face, which may be influenced by parameters such as material thickness, mass of various components (including the rear member 130 and/or the face member 120), intended use of the head 101, and others. The hardness and resiliency may be achieved through techniques such as material selection and any of a variety of treatments performed on the material that can affect the hardness or resiliency of the resilient material, as discussed elsewhere herein. The hardness and thickness of the resilient material may be tuned to the weight of a particular rear member 130. For example, heavier weights may require harder resilient materials, and lighter weights may require softer resilient materials. Using a thinner resilient member 140 may also necessitate the use of a softer resilient material, and thicker resilient members 140 may be usable with harder resilient materials. In a configuration where the resilient material is a polyurethane-based material having a hardness of approximately 65 Shore A, the resilient member 140 may have a thickness between the rear member 130 and the rear surface 122 of the face member 120 of approximately 1-5 mm in one embodiment, or approximately 3 mm in another embodiment.

In the embodiment shown in FIGS. 1-6, the resilient member 140 may be formed as a single, integral piece; however the resilient member 140 may be formed of separate pieces in various embodiments. The resilient member 140 may be formed of multiple components as well, including components having different hardness levels in different regions of the resilient member 140, including different hardness distributions. For example, the resilient member 140 may be formed of an exterior shell that has a different (higher or lower) hardness than the interior of the resilient member 140, such as through being made of a different material (e.g. through co-molding) and/or being treated using a technique to achieve a different hardness. Examples of techniques for achieving a shell with a different hardness include plasma or corona treatment, adhesively bonding a film to the exterior, coating the exterior (such as by spraying or dipping), and others. In the case of a cast or other polyurethane-based resilient material, the resilient material may have a thermoplastic polyurethane (TPU) film bonded to the exterior, a higher or lower hardness polyurethane coating applied by spraying or dipping, or another polymer coating (e.g. a thermoset polymer), which may be applied, for example, by dipping the resilient material into an appropriate polymer solution with an appropriate solvent. Additionally, the resilient member 140 may have different hardness or compressibility in different lateral or vertical portions of the resilient member 140, which can create different energy and/or momentum transfer effects in different locations. For example, the resilient member 140 may have a higher or lower hardness in proximate the heel edge 123 and/or the toe edge 124 of the face member 120, which may be achieved by techniques described herein, such as treatments or use of different materials and/or separate pieces. In this configuration, the hardness of the resilient member 140 may be customized for use by a particular golfer or a particular golfer's hitting pattern. Similarly, an asymmetrical resilient member 140 may also be used to create different energy and/or momentum transfer effects, by providing a larger or smaller amount of material at specific portions of the face member 120. Such an asymmetrical resilient member 140 may also be used to provide customizability. A variable-hardness or asymmetrical resilient member 140 may also be used in conjunction with an offset connection point, as discussed below, for further customizability. Other embodiments described herein may also employ a resilient member that has a variable hardness or asymmetrical features. A single-component or multi-component resilient member 140 may be manufactured by co-molding, and may be co-molded in connection with the face member 120 and/or the rear member 130.

As seen in FIGS. 1-6, the resilient member 140 is connected between the rear member 130 and the face member 120. In one embodiment, the rear member 130 has at least one surface that is engaged by the resilient member 140 and at least one other surface that is exposed and not engaged by the resilient member 140. In the embodiment of FIGS. 1-6, the front surface 131 of the rear member 130 is engaged by the resilient member 140, and the periphery of the rear member 130 (e.g., the top, bottom, heel 133, toe 134) and the rear side 136 are exposed and not engaged by the resilient member 140. As shown in FIGS. 3-6, the resilient member 140 engages the rear surface 122 of the face member 120 and the front surface 131 of the rear member 130. The rear member 130 is spaced from the face member 120, and the resilient member 140 at least partially fills the spaces 141 between the front surface 131 of the rear member 130 and the rear surface 122 of the face member 120. The resilient member 140 may be positioned at least on both opposite lateral sides of the center of gravity (CG) of the face member 120. In one embodiment, as shown in FIG. 5, the resilient member 140 completely or substantially completely fills the spaces 142 between the rear member 130 and the face member 120. In another embodiment, the resilient member 140 may be positioned at least between the heel edges 123, 133 and between the toe edges 124, 134 of the face member 120 and the rear member 130. In a further embodiment, the head 101 of FIGS. 1-6 may have a resilient member 140 that only partially fills the spaces 141 between the face member 120 and the rear member 130.

The rear member 130 may be configured such that energy and/or momentum can be transferred between the rear member 130 and the face member 120 during impact, including an off-center impact on the striking surface 110. The resilient member 140 can serve to transfer energy and/or momentum between the rear member 130 and the face member 120 during impact. It is understood that the joint 161 formed by the connection members may also transfer energy and/or momentum, and that the joint 161 may also permit the resilient member 140 to transfer energy and/or momentum. Additionally, the rear member 130 may also be configured to resist deflection of the face member 120 upon impact of the ball on the striking surface 110 in some embodiments. The resiliency and compression of the resilient member 140 permits this transfer of energy and/or momentum from the rear member 130 to the face member 120. As described above, the momentum of the rear member 130 compresses the resilient member 140, and causes the resilient member 140 to exert a response force on the face member 120 to achieve this transfer of energy and/or momentum. The resilient member 140 may exert at least a portion of the response force on the face member 120 through expansion after the compression. The rear member 130 may deflect slightly toward the impact point to compress the resilient member 140 in the process of this momentum transfer. The actions achieving the transfer of momentum occur between the beginning and the end of the impact, which in one embodiment of a golf iron may be between 4-5 ms. In the embodiment as shown in FIGS. 1-6, the rear member 130 may transfer a greater or smaller amount of energy and/or momentum depending on the location of the impact on the striking surface 110. For example, in this embodiment, upon an off-center impact of the ball centered on the heel side of the face 112, the heel 123 of the face member 120 tends to deflect rearwardly. As another example, upon an off-center impact of the ball centered on the toe side of the face 112, the toe 124 of the face member 120 tends to deflect rearwardly. As the heel 123 or toe 124 of the face member 120 begins to deflect rearwardly, at least some of the forward momentum of the rear member 130 is transferred to the face member 120 during impact to resist this deflection. In the embodiment of FIGS. 1-6, on a heel-side impact, at least some of the momentum transferred to the face member 120 may be transferred from the heel edge 133 of the rear member 130 during impact. Likewise, on a toe-side impact, at least some of the momentum transferred to the face member 120 may be transferred from the toe edge 134 of the rear member 130 during impact. Generally, at least some of the momentum is transferred toward the impact point on the ball striking surface 110.

The resilient member 140 can function to transfer the energy and/or momentum of the rear member 130 to the heel 123 or toe 124 of the face member 120. In the process of transferring energy and/or momentum during impact, the resilient member 140 may be compressed by the momentum of the rear member 130 and expand to exert a response force on the face member 120, which resists deflection of the face member 120 as described above. It is understood that the degree of potential moment causing deflection of the face member 120 may increase as the impact location diverges from the center of gravity of the face member 120. In one embodiment, the energy and/or momentum transfer from the rear member 130 to the face member 120 may also increase as the impact location diverges from the center of gravity of the face member 120, to provide increased resistance to such deflection of the face member 120. In other words, the energy and/or momentum transferred from the rear member 130 to the face member 120, and the force exerted on the face member 120 by the rear member 130, through the resilient member 140 and/or the joint 161, may be incremental and directly relative/proportional to the distance the impact is made from the optimal impact point (e.g. the lateral centerpoint of the striking surface 110 and/or the CG of the face member 120, in exemplary embodiments). Thus, the head 101 will transfer the energy and/or momentum of the rear member 130 incrementally in the direction in which the ball makes contact away from the center of gravity of the head 101, via the rear member 130 suspended by the resilient member 140. The transfer of energy and/or momentum between the rear member 130 and the face member 120 can reduce the degree of twisting of the face 111 and keep the face 111 more squared upon impacts, including off-center impacts. Additionally, the transfer of energy and/or momentum between the rear member 130 and the face member 120 can minimize energy loss on off-center impacts, resulting in more consistent ball distance on impacts anywhere on the face 111. The resilient member 140 may have some elasticity or response force that assists in transferring energy and/or momentum between the rear member 130 and the face member 120. Likewise, the rear member 130 and the resilient member 140 may additionally be configured to transfer energy and/or momentum to the face member 120 as a result of impacts that are higher or lower than the center of the face 111 and/or the CG of the face member 120.

Aspects of the disclosure relate to particular structures of the golf club head body 107 and the shaft engaging member 109. According to some examples of this invention, the golf club head body 107 and the shaft engaging member 109 may be separate pieces that are configured to be engaged with each other. One embodiment of such a configuration is illustrated in FIGS. 1-6. It is understood that the shaft engaging member 109 may be integrally formed with or otherwise connected to the body 107 in some embodiments. For example, the shaft engaging member 109 may be formed as a conventional hosel structure, which may be integral with at least one other component of the head 101.

According to aspects of the disclosure, the golf club head body 107 may be configured to engage with the shaft engaging member 109. For example, as shown in FIGS. 1-6, the golf club head body 107 may include a connecting structure 150, such as a hole or passage 108, configured to receive a portion of the shaft engaging member 109. According to aspects of the disclosure, the passage 108 may be provided in the golf club head body 107 in a variety of ways. For example, the passage 108 may be bored or otherwise created in a machining method, or may be created in an extrusion method. Also, the passage 108 may be formed in the golf club head body 107 during manufacturing, such as when the golf club head body 107 is created by forging, casting, molding, and/or other techniques and processes. The connecting structure 150 may include one or more engaging surfaces 170 associated with the passage 108. In the embodiment of FIGS. 1-6, the passage 108 includes engaging surfaces 170 on the face member 120 and the rear member 130 that combine to define at least a portion of the passage 108, such that each engaging surface 170 defines one side of the passage 108. In the embodiment of FIGS. 1-6, the passage 108 extends inwardly into the body 107 in a heel-to-toe direction, and the passage 108 is in communication with the rear cavity 115 of the body 107. Thus, in this configuration, the passage 108 includes an enclosed portion 104 that is enclosed by the face and rear members 120, 130, and an open portion 102 that is exposed and in direct communication with the rear cavity 115.

According to aspects of the disclosure, the passage 108 may be formed in a side of the golf club head body 107 which is configured to engage with the shaft engaging member 109. For example, the passage 108 may be positioned in the heel end **107*d* of the golf club head body 107. Such an illustrative embodiment is shown in FIGS. 1-6. As seen in FIGS. 2-3, the passage 108 extends from the plane formed from the flat surface at the heel end 107*d* of the golf club head body 107 into the golf club head body 107. According to aspects of the disclosure, the passage 108 may extend between 0.2-1.0 inches, 0.4-0.8 inches or 0.5-0.6 inches into the golf club head body 107. If desired, the passage 108 may be tapered so that the diameter becomes narrower as it extends farther into the golf club head body 107. As long as the shaft engaging member 109 and the golf club head body 107 are securely engaged, the distance or depth into the golf club head body 107 which the passage 108 extends may be varied as desired. For example, in some embodiments of the disclosure, the passage 108 may extend into the golf club head body 107 across substantially the entire length of the golf club head body 107 or the entire length of the length of the sole of the golf club head body 107. In other words, the passage 108 may extend into the golf club head body 107** over 60%, 70%, 80%, 90% or 95% of the length of the of the golf club head body 107 or 60%, 70%, 80%, 90% or 95% of the length of the length of the sole of the golf club head body 107.

According to aspects of the disclosure, the width (e.g., the diameter) at the opening of passage 108 may be varied as desired. According to some aspects of the disclosure, the opening of the passage 108 may have an opening 171 at the heel end 107*d* of the body 107 with a width of 0.25-0.75 inches, 0.4-0.6 inches or 0.5-0.55 inches. Further, the opening 171 of the passage 108 may be in a range of 20-70%, 30-60% or 40-50% of a total surface area of the heel end 107*d* of the golf club head body 107. According to aspects of the disclosure, the shape of the opening of the passage 108 may be configured as desired. For example, the shape of the opening 171 of the passage 108 may be circular, triangular, square or rectangular, other polygons, serrated, etc. The shaft engaging member 109 may be configured in a complementary structure so that the shaft engaging member 109 may be rotationally locked with respect to the body 107. For example, in the embodiment shown in FIGS. 1-6, the passage 108 and the shaft engaging member 109 may have a plurality of interlocking gear teeth. Further, while only a single passage is shown in the depicted embodiment, multiple passages may be provided and used if desired.

According to aspects of the disclosure, the passage 108 may be configured as a horizontal, or relatively horizontal, hole in the golf club head body 107 (when the club head 101 is in a ball address orientation). For example, as seen in the depicted embodiment, the passage 108 extends in a horizontal fashion in the toe-heel direction of the golf club head body 107. However, if desired, the passage 108 may be configured to create an angled hole in the golf club head body 107. For example, the passage 108 may be angled upwardly or downwardly relative to the heel to toe direction for the golf club head 107.

According to aspects of the disclosure, the passage 108 may be positioned relatively low in the golf club head body 107 when the club head 101 is in a ball address orientation. For example, the passage 108 may be positioned closer to sole 107*b* of the golf club head body 107 than the top 107*a* of the golf club head body 107. As some more specific examples, the passage 108 may be positioned such that it is in the lower half, lower third, or lower quarter of an overall height, of the golf club head body 107 (e.g., as measured from the sole to the highest point of the golf club head body 107 when the when the club head 101 is in a ball address orientation). Further, according to aspects of the disclosure, the passage 108 may be positioned such that it is just above the sole 107*b* of the club head body 107 (e.g., the lower edge of the passage 108 may be within approximately 0.125 to 0.25 inches above the sole 107*b* of the golf club head body 107).

As discussed above, the golf club head 101 may include a shaft engaging member 109. The shaft engaging member may 109 may be configured to receive or otherwise engage the shaft 103 and, further, to engage the golf club head body 107. According to aspects of the disclosure, and the shaft engaging member 109 may be constructed in any suitable or desired manner and/or from any suitable or desired materials without departing from this disclosure, including from conventional materials and/or in conventional manners known and used in the art for making golf club heads and parts of golf club heads. For example, according to aspects of the disclosure, similarly to the golf club head body 107, the shaft engaging member 109 may be formed in a variety of ways, such as forging, casting, molding (including injection molding and other types), and/or other techniques and processes and may be made from durable materials, such as metals (e.g., steel, alloys, etc.) plastics, polymers, etc. Further, as seen in FIGS. 2A and 6, according to aspects of the disclosure, the shaft engaging member 109 may include a first portion 109*a* configured to engage with the shaft 103 of the golf club and a second portion 109*b* configured to engage with the club head body 107.

According to aspects of the disclosure, the first portion 109*a* may be oriented so that it extends upward and away from the golf club head body 107 when engaged with the golf club head body 107 and the golf club 100 is at the ball address position. In this configuration, the first portion 109*a* may be considered to be in the form of an upwardly extending leg. Further, according to aspects of the disclosure, the first portion 109*a* of the shaft engaging member 109 may include a hosel or other structure for engaging the shaft. According to aspects of the disclosure, the shaft 103 may be received in and/or inserted into and/or through the hosel.

If desired, the first portion 109*a* of the shaft engaging member 109 may be configured such that the shaft 103 may be engaged with the first portion 109*a* of the shaft engaging member 109 in a releasable and/or adjustable manner using mechanical connectors to allow easy interchange of one shaft for another on the head and/or to allow adjustment of the orientation of the shaft 103 with respect to the golf club head body 107. For example, threads, locking mechanisms, fasteners, etc. may be incorporated into the first portion 109*a* of the shaft engaging member 109, and the end of the shaft 103 that is to be engaged with the first portion 109*a* of the shaft engaging member 109 may be configured with a corresponding configuration. Alternatively, the shaft 103 may be secured to the shaft connecting member 109 via bonding with adhesives or cements, welding (e.g., laser welding), soldering, brazing, or other fusing techniques, etc. Further, optionally, if desired, the hosel may be eliminated and the shaft 103 may be otherwise attached to the golf club head 101 through the first portion 109*a* of the shaft engaging member 109 of the golf club head 101. For example, the shaft 103 may be otherwise engaged with the first portion 109*a* of the shaft engaging member 109 by butt welding, laser welding, other type of welding; bonding with adhesives or cements, soldering, brazing, or other fusing techniques; etc. In a further embodiment, the shaft engaging member 109 may be integrally formed with the shaft 103, e.g., the first portion 109*a* of the shaft engaging member 109 may be integrally formed with the shaft 103, rather than the shaft 103 being easily removable from the shaft engaging member 109 as described above.

As discussed above, according to aspects of the disclosure, the shaft engaging member 109 may include a second portion 109*b* that is configured to engage with the club head body 107. As seen in FIGS. 2A and 6, according to aspects of the disclosure, the second portion 109*b* may be oriented so that it extends horizontally, or relatively horizontally, when engaged with the golf club head body 107 and the golf club 100 is at the ball address position. If desired, the shaft engaging member 109 may be configured such that an obtuse angle is defined between the first portion 109*a* of the shaft engaging member 109 and the second portion 109*b* of the shaft engaging member 109. The juncture formed between the second portion of the shaft connecting member 109*b* and the first portion of the shaft connecting member 109*a* may define the top of the second portion of the shaft connecting member 109*b*. In such embodiments, the second portion of the shaft connecting member 109*b* is considered to not extend above the horizontal, or relatively horizontal, line (when the club head 101 is at the ball address position) that defines, in part, the angle formed between the second portion of the shaft connecting member 109*b* and the first portion of the shaft connecting member 109*a*. FIG. 2A illustrates such a line in broken line format. The second portion 109*b* may include a shoulder area 109*d* configured to abut or engage the heel end 107*d* of the body 107, and a protrusion 109*c* extending from the shoulder area 109*d* and configured to be received within the body 107.

According to aspects of the disclosure, the second portion 109*b* of the shaft engaging member 109 may be configured such that the top of the second portion 109*b* does not engage with the top of the golf club head body 107. For example, according to aspects of the disclosure, when engaged with the golf club head body 107, the top of the second portion 109*b* of the shaft engaging member 109 may be at a position that is less than ¾ of the height of the heel end 107*d* of the golf club head body 107 or less than ¾ of the height of the overall golf club head body 107. Further, according to aspects of the disclosure, when engaged with the golf club head body 107, the top of the second portion 109*b* of the shaft engaging member 109 may be at a position that is less than ½ or ¼ of the height of the heel end 107*d* of the golf club head body 107.

Figure 2B:
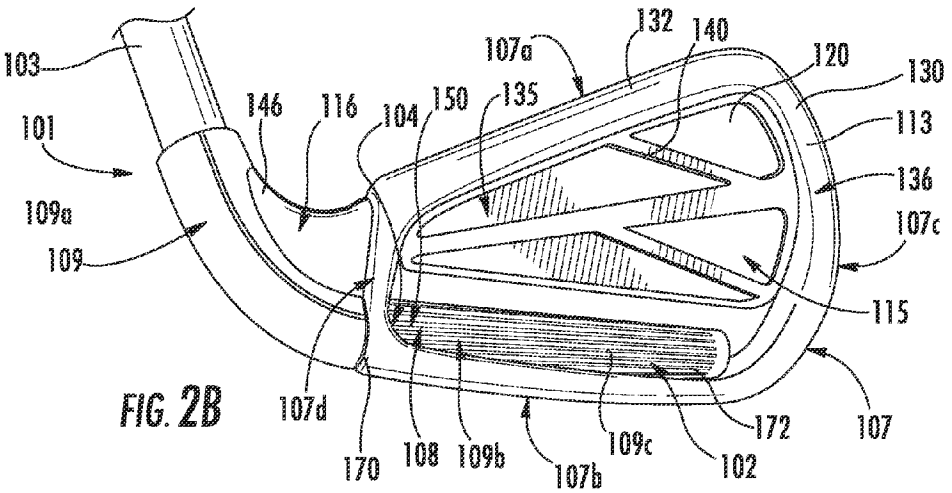
FIG. 2B is a rear view of the head of the iron-type golf club shown in FIG. 1.
Figure 3:
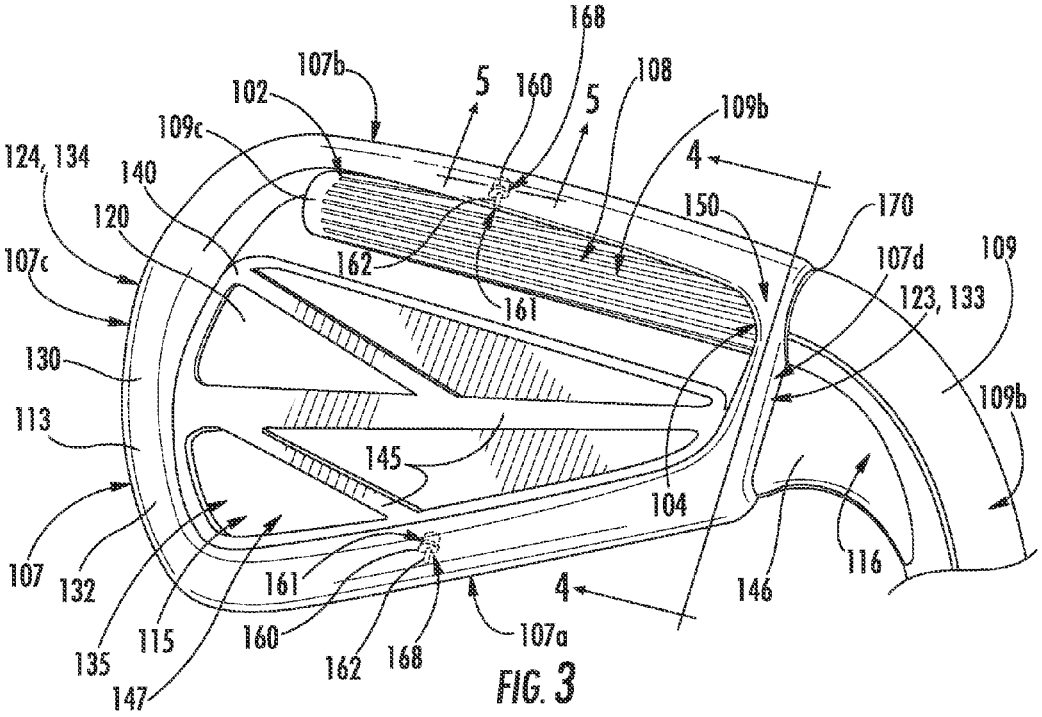
FIG. 3 is an enlarged rear view of the head of the iron-type golf club shown in FIG. 1, with connecting structure shown in broken lines.
Figure 4:
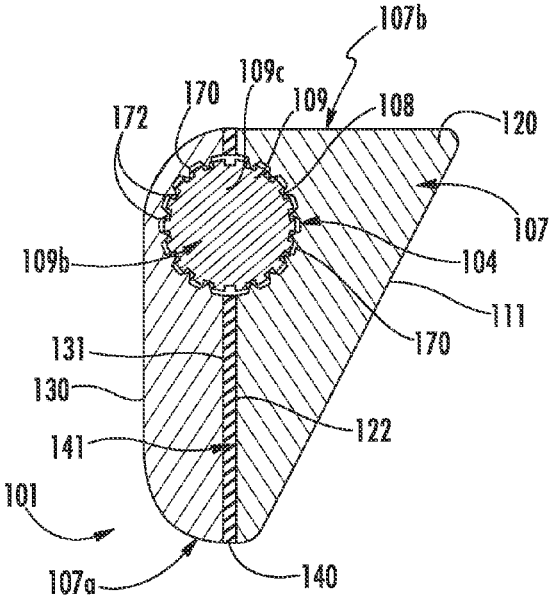
FIG. 4 is a cross-section view taken along lines 4-4 in FIG. 3.

Therefore, as seen in FIGS. 2B and 6, in such a configuration, a space or gap 116 is provided between heel end 107*d* of the golf club head body 107 and the first portion 109*a* of the shaft engaging member 109. For example, according to aspects of the disclosure, the golf club head body 107 and the shaft engaging member 109 may be configured to provide a space or gap 116 between the upper portion (e.g., the upper ¾, ½, ¼, etc.) of the heel end 107*d* of club head body 107 and the shaft engaging member 109 when the shaft engaging member 109 is engaged with the club head body 107.

According to aspects of the disclosure, the second portion 109*b* of the shaft engaging member 109 may be configured such that when engaged with the golf club head body 107, the connection between the shaft engaging member 109 and the golf club head body 107 is below the center of gravity of the iron-type golf club head 101 and/or below the center of gravity of the iron-type golf club head body 107 and/or below the geometric center of the ball striking face 111 of the iron-type golf club head. For example, according to aspects of the disclosure, the second portion 109*b* of the shaft engaging member 109 may be configured such that when engaged with the golf club head body 107, the entire second portion 109*b* of the shaft engaging member 109 (e.g., the entire protrusion 109*c*) is below the center of gravity of the iron-type golf club head 101 and/or below the center of gravity of the iron-type golf club head body 107 and/or below the center of the ball striking face of the iron-type golf club head 101. Similarly, the body 107 may be configured such that the entire connecting structure 150 of the body 107 (e.g., the passage 108 in one embodiment) is located below the center of gravity of the head 101 and/or below the center of gravity of the body 107 and/or below the geometric center of the ball striking face 111 of the iron-type golf club head.

For example, FIG. 2A illustrates the golf club head 101 wherein the center of gravity of the golf club head 101 is shown symbolically at reference numeral 117. Further, the axis along which the golf club head body 107 and the shaft engaging member 109 are connected is shown symbolically at reference numeral 118. As seen in FIG. 2A, the entire connection between the golf club head body 107 and the shaft engaging member 109 is below the center of gravity 117 of the iron-type golf club head 101 (when the club head is oriented in a ball address position). This is in contrast to a typical or conventional iron-type golf club head, which typically does not have an entire connection between the golf club head body and the shaft engaging member below the center of gravity of the golf club head.

An iron-type golf club head configured according to aspects of the disclosure can be particularly advantageous. For example, as will be described in detail below, positioning the connection between the golf club head body and the shaft engaging member below the center of gravity of the golf club head and/or the center of gravity of the golf club head body and below the preferred impact position between the golf ball and the ball striking face, may act to provide increased energy transfer. Further, as will be described in detail below, positioning the connection between the golf club head body and the shaft engaging member below the center of gravity of the golf club head and/or the center of gravity of the golf club head body and below the preferred impact position between the golf ball and the ball striking face, may act to increase "feel" of the golf club, or provide better frequencies of feel to the golfer.

The body 107 and the shaft engaging member 109 may be configured to create a more visually seamless appearance. For example, in the embodiment of FIGS. 1-6, the resilient member 140 has an extension 146 that extends from the heel end 107*d* of the body 107 to form a shroud that at least partially covers the shaft engaging member 109 and/or the gap 116 between the heel end 107*d* and the first portion 109*a* of the shaft engaging member 109. In the embodiment of FIGS. 1-6, the extension 146 jogs rearwardly outside the periphery of the face and rear members 120, 130, extends completely across the gap 116, and engages the first portion 109*a* of the shaft engaging member 109. It is understood that the extension 146 may have a different configuration in other embodiments, and may surround or wrap around a portion of the shaft engaging member 109 in one embodiment. The shroud formed by the extension 146 may have any properties or configurations of the separate shroud 246 described herein with respect to FIGS. 10-13. In another embodiment, the resilient member 140 may not have an extension, and the head 101 may include a separate shroud (e.g., as shown in FIGS. 10-13) or no shroud. In a further embodiment, the second portion 109*b* of the shaft engaging member 109 may be configured with an outer surface that aligns with a corresponding outer surface of the golf club head body 107. For example, the shoulder area 109*d* of the second portion 109*b* of the shaft engaging member 109 may be configured such that the front surface of the shoulder area 109*d* aligns with the front surface, or ball striking surface 110, of the golf club head 101 when the shaft engaging member 109 is engaged with the golf club head body 107. Similarly, such a shoulder area may be configured such that the bottom surface and rear surface of the shoulder area align with a respective sole surface and rear surface of the golf club head body 107 when the shaft engaging member 109 is engaged with the golf club head body 107. In this way, there may be a relatively seamless engagement between the shaft engaging member 109 and the golf club head body 107 (at least along a portion or a majority of the engaged surfaces) when shaft engaging member 109 is engaged with the golf club head body 107. Optionally, any seams between the golf club body 107, the shaft engaging member 109 and/or any shroud structure may be concealed, e.g., by paint, by chroming or electroplating, by coating, or in some other manner.

According to aspects of the disclosure, the second portion 109*b* may include a protrusion 109*c* that extends from the shoulder 109*d* of the second portion 109*b*. According to aspects of the disclosure, the protrusion 109*c* may extend from a side of the shoulder 109*d* of the second portion 109*b* of the shaft engaging member 109. The protrusion 109*c* may form the majority, the entirety or the substantial entirety of the second portion 109*b* of the shaft engaging member. In another embodiment, the protrusion 109*c* may extend outward from a relatively vertical plane formed defined at on the second portion 109*b* of the shaft engaging member 109.

Further, the protrusion 109*c* may be configured to extend into and engage with and/or be received in the connecting structure 150 of the club head body member 107, such as the passage 108 in FIGS. 2-3. For example, the protrusion 109*c* may be a tubular protrusion and fits into the passage 108 of the club head body member 107. Further, the protrusion 109*c* may be sized and configured such that when engaged with the passage 108, an outer surface of the second portion 109*b* of the shaft engaging member 109 matches and mates with a corresponding outer surface of the golf club head body 107 (e.g., in a relatively seamless manner such as described above). Thus, the protrusion 109*c* and the passage 108 may have various corresponding or cooperating shapes.

According to aspects of the disclosure, the protrusion 109*c* may be configured in a variety of ways. For example, the protrusion 109*c* may be formed on the shaft engaging member 109 during manufacturing, such as when the shaft engaging member 109 is created by forging, casting, molding, and/or other techniques and processes. Also, the protrusion 109*c* may be attached to the shaft engaging member 109 after manufacture of the shaft engaging member 109. For example, according to aspects of the disclosure, protrusion 109*c* may be a separate peg or dowel that is engaged with the shaft engaging member 109 (e.g., by welding, by cements, etc.).

According to aspects of the disclosure, the protrusion 109*c* may extend between 0.2-1.0 inches, 0.4-0.8 inches or 0.5-0.6 inches away from the point of engagement of the second portion 109*b* of the shaft engaging member 109 with the body 107 (e.g., the shoulder area 109*d*). As long as the shaft engaging member 109 and the golf club head body 107 are securely engaged, the distance or depth that the protrusion 109*c* extends out of the shaft engaging member 109 may be varied as desired. For example, in some embodiments of the disclosure, the protrusion 109*c* may extend out of the shaft engaging member 109 for a length that is substantially the entire length of the golf club head body 107. In other words, the protrusion 109*c* may extend out of the shaft engaging member 109 over 60%, 70%, 80%, 90% or 95% of the length of the of the golf club head body 107 or the 60%, 70%, 80%, 90% or 95% of the length of the sole of the golf club head body 107. In this way, the protrusion 109*c* may engage with and fill a corresponding passage 108 that extends into the golf club head body 107 by the same or similar dimension.

FIGS. 1-6 show an illustrative embodiment of the disclosure, where the passage 108 and the protrusion 109*c* have lengths which extend substantially the entire length of the golf club head body 107. It is noted that in such an embodiment, the weight of the golf club head 101 may be more centered. Further, the protrusion 109*c* may be formed with a varied weight, e.g., by varied density or thickness, along its length such that the protrusion 109*c* may provide more weight at a particular portion of the golf club head 101 (e.g., heel or toe weighted).

According to further aspects of the disclosure, the width (e.g., the diameter) of the protrusion 109*c* may be varied as desired. According to some aspects of the disclosure, the protrusion 109*c* may have a width of 0.25-0.75 inches, 0.4-0.6 inches or 0.5-0.55 inches. According to aspects of the disclosure, the shape of the protrusion 109*c* may be configured as desired. For example, the shape of the protrusion 109*c* may be circular, triangular, square or rectangular, etc. in order to correspond to the shape of the passage 108 in the golf club head body 107. It is noted that while only a single protrusion 109*c* is shown in the depicted embodiment, multiple protrusions may be used if desired. As mentioned above, the protrusion 109*c* may be configured in a complementary structure so that the shaft engaging member 109 may be rotationally locked with respect to the body 107. For example, in one embodiment, the passage 108 and the protrusion 109*c* may have a plurality of interlocking gear teeth 172 or other locking surfaces, such as in the embodiment shown in FIGS. 1-6. Other rotational locking structure may be used in other embodiments. Generally, the passage 108 and the protrusion 109*c* may have nearly identical, symmetrical, non-circular cross-sectional shapes that can engage in a plurality of positions. For example, the passage 108 and the protrusion 109*c* may have identical polygonal shapes, such as shapes having a large number of sides to provide a large number of different locking positions. Further rotational locking structures are contemplated.

Figure 23:
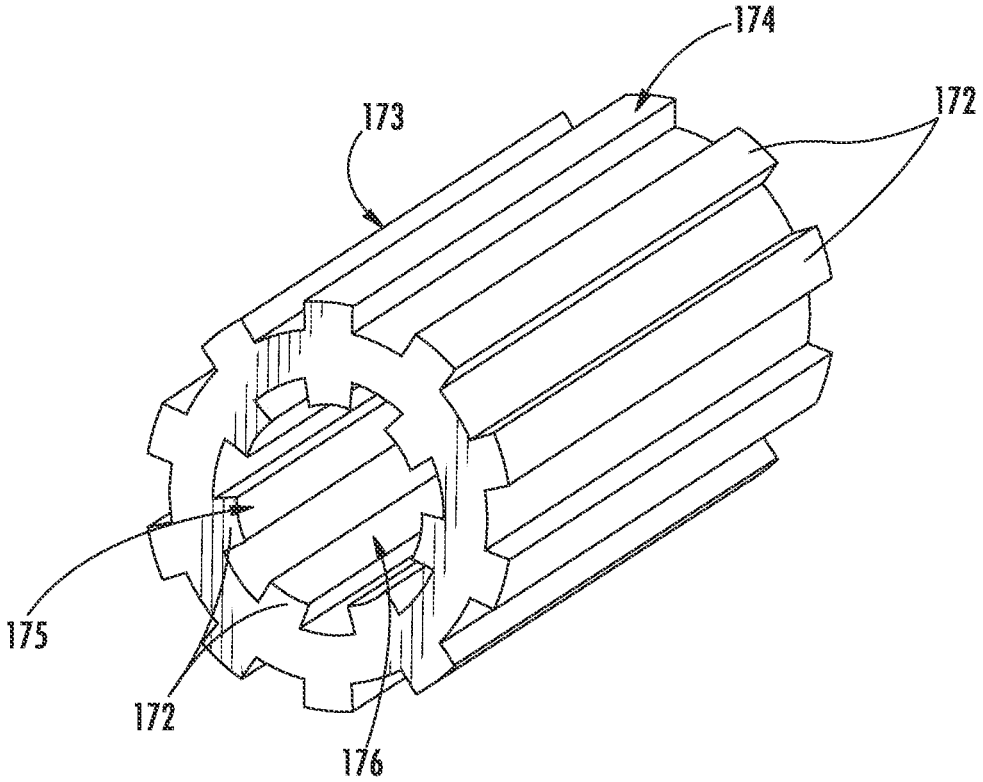
FIG. 23 is a perspective view of an illustrative embodiment of a rotational locking sleeve that is configured for use with an iron-type golf club head according to aspects of the disclosure.

FIG. 23 illustrates an embodiment of a structure for providing interlocking gear teeth 172 with a greater number of options for rotational locking engagement. FIG. 23 illustrates a sleeve 173 having an outer surface 174 and an inner surface 175 defining a central passage 176, each with a plurality of locking gear teeth. The sleeve 173 is configured so that at least a portion of the protrusion 109*c* fits inside the central passage 176, and the gear teeth 172 of the inner surface 175 and the protrusion 109*c* interlock with each other. The protrusion 109*c* and the sleeve 173 can then be inserted into the passage 108, so that the gear teeth 172 on the passage 108 and on the outer surface 174 of the sleeve 173 interlock with each other. This provides a significantly larger number of options for rotational locking positions, which in turn permits smaller rotational adjustment increments. It is understood that the sleeve 173 of FIG. 23 may be used in connection with any embodiment described herein.

According to aspects of the disclosure, the protrusion 109*c* may be configured to extend horizontally, or relatively horizontally, away from the shoulder area 109*d* of the shaft engaging mechanism 109. For example, as seen in the depicted embodiment, the protrusion 109*c* extends in a horizontal fashion in the toe-heel direction of the golf club head 101. However, if desired, the protrusion 109*c* may be configured to extend from the shaft engaging member 109 at an angle. For example, the protrusion 109*c* may be angled upwardly or downwardly relative to the heel to toe direction of the shaft engaging member 109.

According to aspects of the disclosure, the protrusion 109*c* may be positioned relatively low in the shaft engaging member 109. For example, the protrusion 109*c* may be positioned closer to the bottom of the shaft engaging member 109 than the top of the shaft engaging member 109. As some more specific examples, the protrusion 109*c* may be positioned such that it is in the lower half, or lower quarter, of the shaft engaging member 109. Further, according to aspects of the disclosure, the protrusion 109*c* may be positioned such that it is extends from the center of the second portion 109*b* of the shaft engaging member 109 (e.g., the lower edge of the protrusion 109*c* may be within approximately 0.125 to 0.25 inches or less from the bottom of the shaft engaging member 109).

In the depicted embodiment as described above, the shaft engaging member 109 may be engaged with the golf club head body 107 by inserting the protrusion 109*c* into the passage 108. Additionally, if desired, the golf club head 101 may include one or more securing or retaining features that aid in securing the engagement of the shaft engaging member 109 with the golf club head body 107, including removable or releasable retaining features. For example, the protrusion 109*c* may include one or more keys or ridges (not shown) that correspond to one or more respective notches at the opening of the passage 108 or within the interior of the of club head body 107. Such keys or ridges on the protrusion 109*c* may be configured to engage with corresponding notches or grooves in the passage 108 in order to engage or lock the club head body 107 with the shaft engaging member 109 (e.g., to prevent twisting of these parts with respect to one another). In this configuration, the keys or ridges of the protrusion 109*c* may be aligned with notches in the passage 108 to allow the protrusion 109*c* to slide into the passage 108. The passage 108 may be configured with grooves that allow the protrusion 109*c* to be rotated from a first position, at which the keys or ridges are aligned with the notches to allow entry of the protrusion 109*c* into the passage 108, to a second position, wherein the keys or ridges of the protrusion 109*c* are no longer aligned with the notches of the passage 108. In this way, the shaft engaging member 109 may be secured or locked within the golf club head body 107. Of course, other securing or retaining features may be provided as well (e.g., threads, recesses, snap fit features, etc.). For example, the end of passage 108 (e.g., close to the toe of the golf club head 101) may include securing, retaining or locking members (e.g., mechanical connectors) which receive corresponding members on the protrusion 109*c* (e.g., expandable/contractible/movable members on the tip end of the protrusion 109*c*) when the protrusion 109*c* is inserted into the passage 108. Such retaining members may prevent the protrusion 109*c* from being disengaged from the passage 108 once the expandable/contractible/movable members on the tip end of the protrusion 109*c* have been received and expanded in the securing, retaining or locking members at the end of the passage 108 and until they are contracted to release from the mechanical connectors. A further example of a retaining structure includes a fastener, such as a screw 119, as illustrated in FIG. 8 and described in greater detail herein.

According to one embodiment, the passage 108 may extend through the entire golf club head body 107. In such an embodiment, there are openings at both the toe end 107*c* and the heel end 107*d* of the golf club head body 107. Further, in such embodiments, the protrusion 109 may be secured via a mechanical connector extends from the opening at the toe end 107*c* of the golf club head body 107.

Therefore, it is understood that the shaft engaging member 109 may be configured to be engaged with the golf club head body 107 in a releasable manner using mechanical connectors. It is noted that in such a configuration, if desired, easy interchange of one shaft for another (e.g., if the shaft 103 is permanently affixed to the shaft engaging member 109) may be accomplished. Further, it is noted that in addition to the above described mechanical connectors, the engagement between the shaft engaging member 109 the golf club head body 107 may be supplemented with other securing means such as bonding with adhesives or cements, welding (e.g., laser welding), soldering, brazing, or other fusing techniques, etc.

Additionally, it is noted that while a passage and a protrusion are specifically described above, the shaft engaging member 109 may be engaged with the golf club head body 107 in any desired manner. For example, according to other embodiments of the disclosure, no protrusions and no passages are used. For example, the shaft engaging member 109 may be engaged with the golf club head body 107 via mechanical connectors (e.g., threads, recesses, snap fit features, etc.) which do not include the protrusion and hole described above. Also, if desired, in addition to such other mechanical connectors, the engagement between the shaft engaging member 109 and the golf club head body 107 may be supplemented with other securing means, such as bonding with adhesives or cements, welding (e.g., laser welding), soldering, brazing, or other fusing techniques, etc.

Further, it is noted that as an alternative to mechanical connectors, such as described above, securing means, such as bonding with adhesives or cements, welding (e.g., laser welding), soldering, brazing, or other fusing techniques, etc., may be employed to secure the shaft engaging member 109 with the golf club head body 107. For example, according to some aspects of the disclosure, the second portion 109*b* of the shaft engaging member 109 may be directly engaged with the golf club head body 107. For example, an outer surface of the second portion 109*b* of the shaft engaging member 109 (e.g., the relatively vertical plane at a toe end of the shaft engaging member 109) may be directly engaged with a corresponding outer surface of the club head body 107 (e.g., the relatively vertical plane at the heel end 107*d* of the club head body 107), such as by a welding process or other technique.

It is also noted that, if desired, according to other aspects of the disclosure, no shaft engaging member 109 is needed. For example, the shaft 103 may be attached directly to the golf club head body 109 or the golf club head 101. For example, the shaft 103 may be configured at its end that is opposite the grip 105 with a configuration to directly engage with the golf club head body 107 or the golf club head 101. For example, the shaft 103 may include a thicker portion that is joined with the golf club head body 107 or the golf club head 101 via mechanical connectors, bonding with adhesives or cements, welding (e.g., laser welding), soldering, brazing, or other fusing techniques, etc. (e.g., joined such that the entire connection is completely below the center of gravity of the golf club head and/or the center of gravity of the iron-type golf club head body and/or the center of the face of the golf club head).

Figure 21:
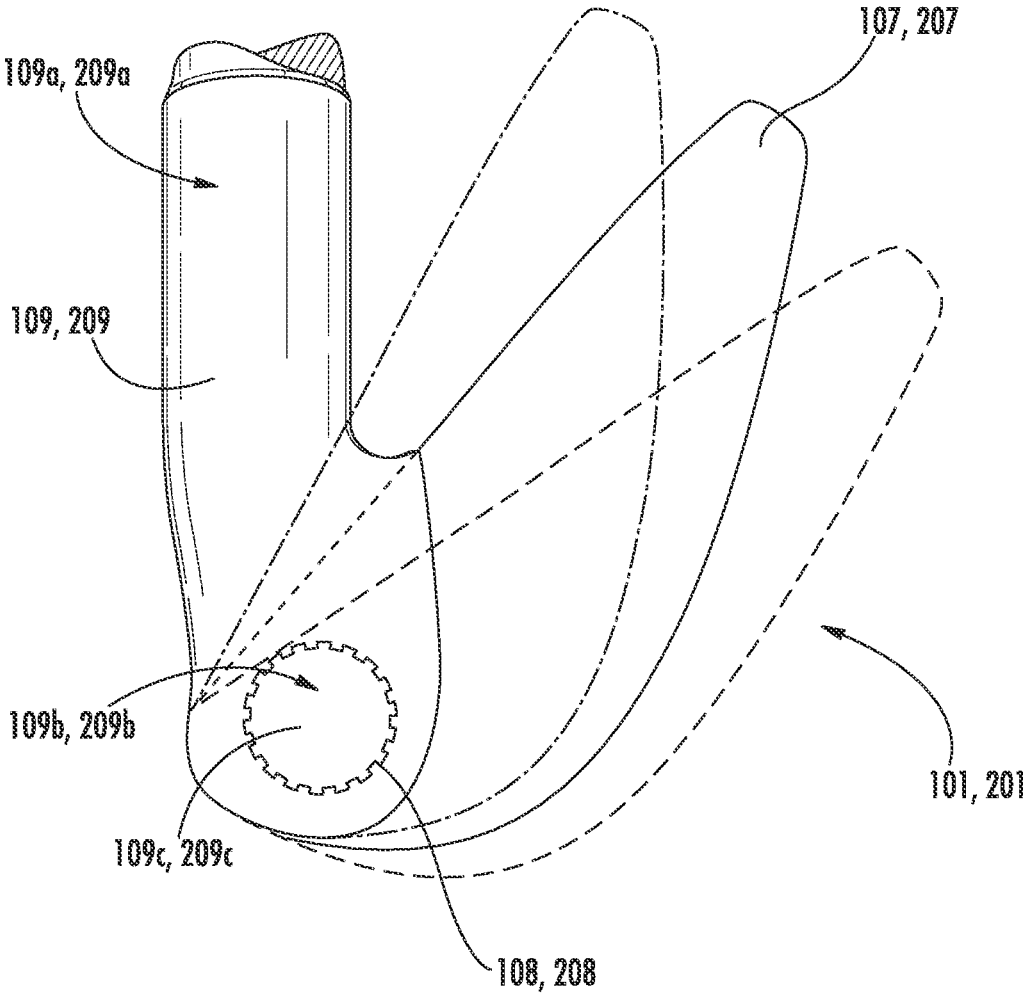
FIG. 21 is a schematic cross-section view of an iron-type golf club head according to aspects of the disclosure, being moveable between a plurality of different rotational positions with respect to a shaft engaging member.

In one embodiment, the body 107 and the shaft engaging member 109 may include complementary rotational locking structure that rotationally locks the body 107 and the shaft engaging member 109 together. Such rotational locking structure may be configured for rotationally locking the body 107 and the shaft engaging member 109 in a plurality of different positions, and the loft angle of the club head 101 changes for the plurality of different positions. An example of these multiple different positions and loft angles are illustrated in FIG. 21. For example, the rotational locking structure may be connectable in at least a first position and a second position, where the club head 101 has a first loft angle and a second loft angle, respectively. In a further embodiment, the rotational locking structure may be releasable and reconnectable, in order to allow the rotational orientations of the body 107 and the shaft engaging member 109 and/or the loft angle of the club head 101 to be adjusted. It is understood that the club head 101 may have releasable connecting structure for connecting to the shaft engaging member 109, as described above. In one example embodiment, such as shown in FIGS. 1-6, both the protrusion 109*c* and the passage 108 may have complementary interlocking gear teeth 172 or other interlocking structure for such rotational locking, as described in greater detail herein. In one embodiment, the rotational locking structure is configured to permit 3° of total relative rotational adjustment (i.e., +/−1.5° from baseline) in 0.5° increments, and the gear teeth 172 may be spaced and configured to provide such incremental adjustment. The sleeve 173 in FIG. 23 may also be used to provide this incremental adjustment.

As shown in FIGS. 1-6, the rotational locking structure in this embodiment includes a plurality of complementary teeth 172 that engage each other to achieve rotational locking. As shown in FIG. 2A, the protrusion 109*c* has gear teeth 172 that extend around the entire or substantially the entire periphery of the protrusion 109*c*. Additionally, the teeth 172 of this embodiment extend the entire or substantially the entire length of the protrusion 109*c*. The passage 108 has complementary teeth 172 at least around the enclosed portion 104 of the passage 108. In another embodiment, the teeth 172 may extend only a portion of the length of the protrusion 109*c*, for example, only the portion of the protrusion 109*c* within the enclosed portion 104 of the passage 108 may have teeth 172. In other embodiments, the teeth 172 may be positioned along a different or additional portion of, or the entire length of, the protrusion 109*c* and/or the passage 108. For example, the protrusion 109*c* may engage one or more walls defining the rear cavity 115, which may have teeth 172 for such engagement (e.g., the rear surface 122 of the face member and/or the front surface 131 of the rear member 130). Additionally, in other embodiments, the teeth 172 may be positioned around at least a portion of or the entire periphery of the protrusion 109*c* and/or the passage 108. In a further embodiment, the rotational locking structure may not be complementary, and either the body 107 or the shaft engaging member 109 may include a rotational locking structure that can lock the head in different rotational positions with respect to the shaft engaging member 109, and thereby lock the head in different loft angles, as described herein and shown in FIG. 21.

The teeth 172 may be arranged and configured so that advancing the rotation of the shaft engaging member 109 relative to the body 107 changes the loft angle of the club head by a set amount, such as 1° per tooth 172, in one embodiment. The embodiment shown in FIGS. 1-6 permits multiple different club heads with different loft angles to be manufactured using the same body member 107 and/or shaft engaging member 109. This can simplify manufacturing by reducing the number of different parts required to produce a full set of club heads, and can thereby reduce costs and increase efficiency. It is understood that different shrouds may be utilized for heads 101 that may include the same body 107 and shaft engaging member 109, in order to maintain flush and contiguous surfaces between the shroud and the body 107 when different loft angles are used. The shaft engaging member 109 may be permanently connected to the body 107 in the correct position for the desired loft angle, such as by welding, soldering, brazing, etc. In a further embodiment, the rotational locking structure in FIGS. 1-6 may be configured to be releasable, reconnectable, and/or adjustable, in order to allow the rotational orientations of the body 107 and the shaft engaging member 109 and/or the loft angle of the club head 601 to be adjusted after manufacturing. A releasable and reconnectable retaining structure may be utilized to retain the body 107 in connection with the shaft engaging member 109 in one of the multiple rotational positions. For example, the fastener 119 shown in FIG. 8 and described herein may be releasable and reconnectable, and these or other structures may be used for this purpose in various embodiments. It is noted that the shaft engaging member 109 and club head body 107 may have other configurations than shown in the depicted embodiment. For example, golf club head body 107 and shaft engaging member 109 may have corresponding configurations, such as corresponding notches and recesses, corresponding stair step configurations, etc.

FIGS. 7-9 illustrate different embodiments of potential configurations of the golf club head 101 shown in FIGS. 1-6 and described herein. The golf club heads 101 shown in FIGS. 7-9 can be used in the same manner as the head 101 described above with respect to FIGS. 1-6, and may include any features or variations described herein with respect to the embodiment of FIGS. 1-6. Additionally, any of the embodiments of FIGS. 1-9 may include any features or variations described herein with respect to any other embodiment of FIGS. 1-9. Accordingly, the embodiments in FIGS. 7-9 are described only with respect to their differences from the embodiment of FIGS. 1-6.

In the embodiment of FIG. 7, the face member 120 has an engaging member 125 that encircles and engages the entire periphery of the protrusion 109*c* of the shaft engaging member 109. The engaging member 125 in this embodiment is located at least at the heel edge 123 of the face member 120 and has an engaging surface 170 that defines the opening 171 of the passage 108. As shown in FIG. 7, the entire engaging member 125 is located proximate the heel edge 123, however in another embodiment, the engaging member 125 may extend a greater distance toward the toe edge 124, and may be an elongated tube in one embodiment. The engaging member 125 in FIG. 7 has rotational locking structure in the form of teeth 172 around the entire inner periphery of the engaging surface 170, configured to engage the rotational locking structure of the shaft engaging member 109 (e.g., teeth 172). The rear member 130 and the resilient member 140 have structures to compensate for the presence of the engaging member 125 in the embodiment in FIG. 7 (e.g., cutouts 137, 147).

In the embodiment of FIG. 8, a screw 119 or other fastener is engaged with the end of the protrusion 109*c*, and connects the protrusion 109*c* to the golf club head body 107. The screw 119 may be received through an aperture 126 in the toe end 107*c* in this embodiment. It is understood that the protrusion 109*c* may have a threaded aperture 109*e* for engaging the fastener 119. The aperture 126 may be defined in the face member 120 or the rear member 130. In the embodiment of FIG. 8, the face member 120 includes a block 127 or other mounting structure having the aperture 126 defined therein, for connection to the protrusion 109*c*. The block 127 is located at the toe end 107*c* of the golf club head body 107 in the embodiment of FIG. 8, and abuts and engages the end of the protrusion 109*c* in this embodiment. The rear member 130 and the resilient member 140 have structures to compensate for the presence of the block 127 in the embodiment in FIG. 8 (e.g., cutouts 137, 147).

In one embodiment, such as illustrated in FIG. 9, the club head body 107 has an engaging member 125 located at the toe end 107*c* to engage the end of the protrusion 109*c*. The engaging member 125 is similar to the engaging member 125 described herein with respect to FIG. 7, being mounted on the face member 120 and encircling the entire periphery of the protrusion 109*c*, and also having rotational locking structure in the form of teeth 172 around the entire inner periphery of the engaging surface 170, configured to engage the rotational locking structure of the shaft engaging member 109 (e.g., teeth 172). In the embodiment of FIG. 9, the engaging member is mounted near the toe edge 124 of the face member 120. It is understood that the engaging member 125 in FIG. 9 may be used in combination with the engaging member 125 in FIG. 7 in one embodiment. In other embodiments, the face member 120 and the rear member 130 may combine to define an engaging member 125 at the toe end 107*c* of the body 107. The engaging member 125 may further provide a location for welding to the protrusion 109*c*, in one embodiment. The rear member 130 and the resilient member 140 have structures to compensate for the presence of the engaging member 125 in the embodiment in FIG. 9 (e.g., cutouts 147).

According to aspects of the disclosure, the golf club head 101 and its components may be constructed in any suitable or desired manner and/or from any suitable or desired materials without departing from this disclosure, including from conventional materials and/or in conventional manners known and used in the art. For example, the club head 101 and/or its various parts may be made by forging, casting, molding, and/or using other techniques and processes, including techniques and processes that are conventional and known in the art. The golf club head 101 may be made of a variety of materials, including materials described above, such as titanium, stainless steel, aluminum, and/or other metallic materials, as well as polymers (including fiber reinforced polymers) and other types of materials. Various portions of the head 101, such as the shaft engaging member 109, the face member 120 and/or the rear member 130, may each be made of a single, integral piece, such as by casting, forging, molding, etc., or may be made of multiple pieces connected together using appropriate techniques. In one embodiment, at least part of the head 101 (e.g., the face member 120 and/or the rear member 130) may be formed of a nanocoated or other coated lightweight material, such as a high strength polymer (e.g., an injection molded plastic) that is coated with a thin layer of a metallic material. For example, in one embodiment, the body 107 may be partially or entirely formed of a high strength polymer such as polyether ether ketone (PEEK) or other high strength polymer, coated with aluminum or other metal. Such a formation can create a complex structure for the body 107 with sufficient strength for performance, while also providing a lightweight structure, which may have a lower weight and/or density than the shaft engaging member 109.

In one embodiment, the entire body 107, or at least the face member 120, may have a lower weight and/or density than the protrusion 109*c* alone, particularly so if the protrusion 109*c* is weighted as described herein. For example, by using a lightweight coated polymer structure to create the body 107, the head 101 can be manufactured so that a significant portion (even a majority) of the weight of the head can be provided by the shaft engaging member 109. Further, in embodiments where the second portion 109*b* of the shaft engaging member 109 is positioned below the center of gravity of the body 107, this configuration can create an overall lower center of gravity for the head 101. Such a lower center of gravity may be desirable for certain clubs and/or golfers, such as to provide a higher ball flight trajectory.

FIGS. 10-22 illustrate additional embodiments of an iron-type golf club 200 with an iron-type golf club head 201 having a face member 220 and a rear member 230, and which is configured for engagement with a shaft engaging member 209. Many features of the golf club head 201 are similar to the embodiments described above and, therefore, will not be discussed in more detail here for the sake of brevity. Such similar or common features are referred to herein using reference numbers similar to those used with respect to FIGS. 1-6, within the "200" series of reference numbers. Such similar or common features already described herein may not be discussed again in complete detail for the sake of brevity. It is understood that the head 201 in FIGS. 10-22 may have any of the structural features described herein with respect to FIGS. 1-9, as well as any variations or alternate embodiments as described herein.

In the embodiment shown in FIGS. 10-13, the club head body 207 has a face 211 that is formed integrally as part of a unitary, one-piece construction with a face member 220 that is connected to a rear member 230. The face member 220 and/or the rear member 230 may each be made of an integral, unitary, one-piece construction in one embodiment, or the face member 220 and/or the rear member 230 may be made from a multi-piece construction in another embodiment. The face member 220 and/or the rear member 230 may include any structures, configurations, or variations described with respect to the members 120, 130 in FIGS. 1-9, such as a separate face plate.

The face member 220 in the embodiment of FIGS. 10-13 has a perimeter weighting member 213 extending rearwardly from the face 211 and defining at least a portion of the periphery of rear cavity 215, such that the perimeter weighting member 213 and the rear cavity 215 at least partially define the rear surface 222 of the face member 220. In the embodiment of FIGS. 10-13, the perimeter weighting member 213 extends rearwardly around the entire periphery of the face 211 and defines the entire periphery of the rear cavity 215. The face member 220 also includes an opening 271 at the heel edge 223 that leads to a passage 208 for receiving and connecting to the shaft engaging member 209, as described in greater detail herein. The face member 220 in this embodiment includes a flat surface at the heel end 223 in which the opening 271 is defined, which surface may be substantially vertical and perpendicular to the striking surface (not shown) and/or the sole surface 207*b* of the body 207. Additionally, in the embodiment of FIGS. 10-14, the face member 220 defines the top 207*a* and the sole 207*b* of the body, and the heel and toe edges 223, 224 of the face member 220 define the heel end 207*d* and the toe end 207*c* of the body 207.

The rear member 230 in the embodiment of FIGS. 10-13 is formed as a plate member that may have a center opening or window 235. The rear member 230 may be at least partially positioned within the rear cavity 215. In the embodiment of FIGS. 10-14, the rear member 230 is entirely or substantially entirely positioned within the rear cavity 215, such that the entire outer periphery of the rear member 230 is positioned within the boundaries defined by the perimeter weighting member 213 and fits within the rear cavity 215. The window 235 of the rear member 230 may permit viewing of components within the rear cavity 215, such as engagement member(s) 180 that engage the face member 220 and the rear member 230. The window 235 has a covering 237 in one embodiment that may be at least partially transparent in order to permit such viewing. The rear member 230 may have a different configuration in another embodiment. For example, the rear member 130 may have no window 235 in one embodiment. In another embodiment, the rear member 230 may have integral and/or separate weighting structures. For example, in the embodiment shown in FIG. 20, the rear member 230 has two weight cavities 238*a* configured to receive removable weight members 238*b* using complementary threading as a connecting structure. The weight cavities 238*a* are positioned proximate the heel and toe edges 233, 234 of the rear member 230, to provide perimeter weighting. It is understood that the weight members 238*b* may have the same or different weights, and may be interchanged for each other or other weight members 238*b* having different weights.

The rear member 230 may have varying sizes and weights in different embodiments. For example, in one embodiment, the rear member 230 may make up about 25-70% of the total weight of the head 201. The rear member 230 may also have various different dimensions and structural properties, including weight distributions, in various embodiments, as similarly described above. Additionally, the rear member 230 may be positioned so that the CG of the rear member 230 is substantially aligned with the CG of the face member 220. In one embodiment, for example as shown in FIGS. 10-13, the CGs of the rear member 230 and the face member 220 are laterally aligned, and these respective CGs may additionally or alternately be vertically aligned in another embodiment. The face member 220 may likewise have various different sizes, weights, weight distributions, dimensions, and structural properties. In other embodiments, the rear member 230 may be differently configured, and/or the head 201 may contain multiple rear members 230, as described above. Further, the rear member 230 may be made of any of a variety of different materials, which may be selected based on their weight or density, and the rear member 230 may be configured to have a greater density than the face member 220 and/or to have areas of locally increased density in one embodiment, including configurations as described above.

In one embodiment, the face member 220 and the rear member 230 are connected and/or engaged such that the rear member 230 is configured to transfer energy and/or momentum to the face member 220 upon impact of the ball on the striking surface, including on an off-center impact. The rear member 230 may be connected to the face member 220 in a number of different configurations that permit energy and/or momentum transfer between the rear member 230 and the face member 220, several of which are described below and shown in the FIGS. In the embodiment illustrated in FIGS. 10-13, the face member 220 is engaged by the rear member 230 through one or more engagement members 280 that create a point of rigid engagement between the face member 220 and the rear member 230, as described in further detail below. The engagement member 280 may be the sole point or area of rigid engagement between the face member 220 and the rear member 230 in one embodiment. For example, in the embodiment of FIGS. 10-13, the engagement member 280 forms the sole area of rigid engagement between the face member 220 and the rear member 230, as the resilient member 240 separates the face member 220 from the rear member 230. The engagement member 280 may also be considered to create a joint 261 between the face member 220 and the rear member 230. In other embodiments, there may be multiple areas of rigid engagement between the face member 220 and the rear member 230, such as by use of multiple engagement members 280 (see FIG. 15), or there may be no points of rigid engagement between the face member 220 and the rear member 230, such as if the club head 201 is not provided with an engagement member (see FIG. 16). It is understood that "rigid" engagement as defined herein does not necessary imply any fixing or attachment, but instead, means that the surfaces engaging each other are rigid, rather than flexible, and behave rigidly during energy and/or momentum transfer. For example, the engagement members 280 illustrated in FIGS. 13-15 may rigidly engage the face member 220 and/or the rear member 230 through non-fixed abutment.

Figure 17:
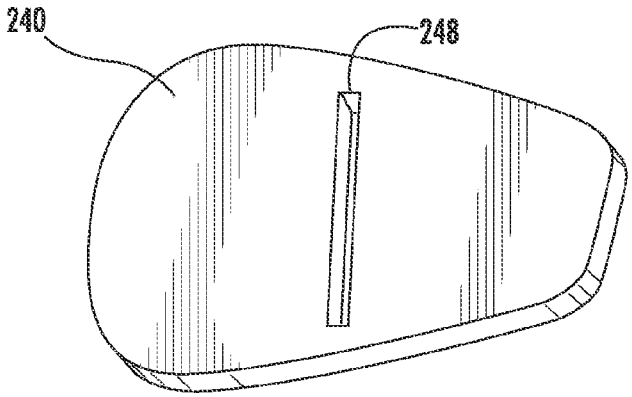
FIG. 17 is a rear view of another illustrative embodiment of a resilient member according to aspects of the disclosure, configured for use in the iron-type golf club head shown in FIGS. 10-13.
Figure 18:
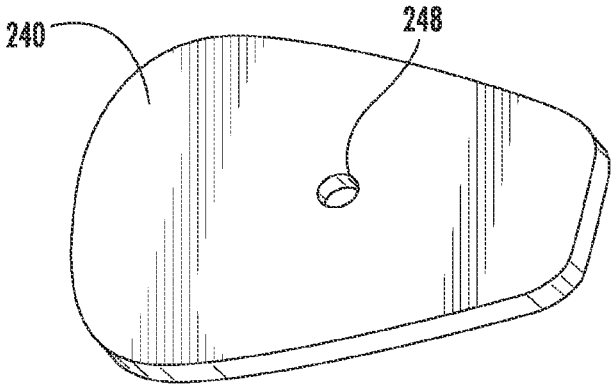
FIG. 18 is a rear view of another illustrative embodiment of a resilient member according to aspects of the disclosure, configured for use in the iron-type golf club head shown in FIG. 14.
Figure 19:
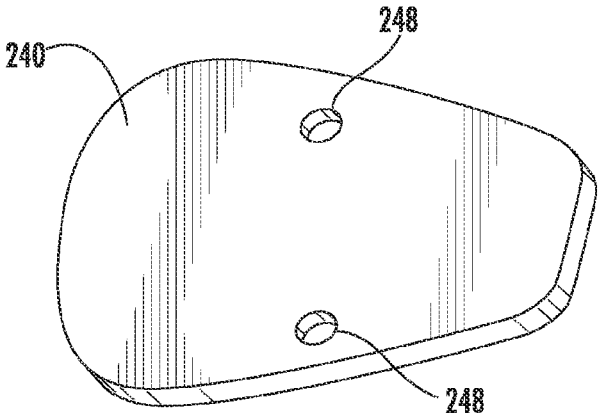
FIG. 19 is a rear view of another illustrative embodiment of a resilient member according to aspects of the disclosure, configured for use in the iron-type golf club head shown in FIG. 15.
Figure 20:
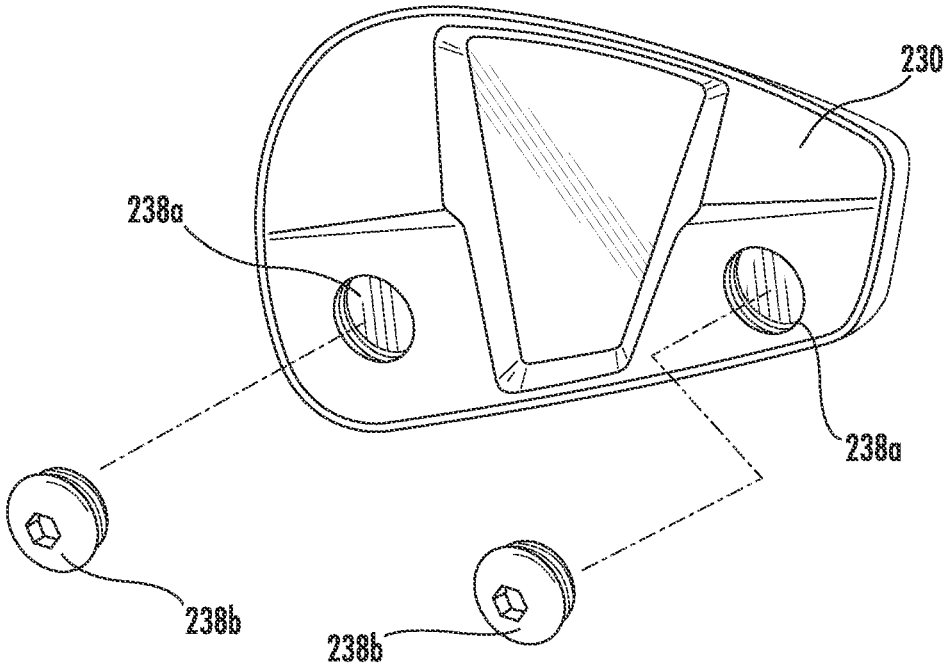
FIG. 20 is a rear view of another illustrative embodiment of a rear member according to aspects of the disclosure, configured for use in iron-type golf club heads as shown in FIGS. 10-16.

The engagement member 280 may have various structural configurations, locations, and orientations. In various embodiments, the engagement member 280 may be fixed to at least one of the face member 220 and the rear member 230, and/or the engagement member may rigidly abut at least one of the face member 220 and the rear member 230 (but without being fixedly connected). In the embodiment illustrated in FIGS. 10-13, the engagement member 280 is a ridge or embossment having a triangular-wedge shape, that extends vertically and is fixed to the rear surface 222 of the face member 220. The engagement member 280 abuts the front surface 231 of the rear member 230, but the engagement member 280 is not fixed or otherwise connected to the rear member 230. In this embodiment, the resilient member 240 includes a gap 248 allowing the engagement member 280 to extend through the resilient member 240 to engage both the face member 220 and the rear member 230. This gap 248 is provided by the resilient member 240 being split into two pieces in the embodiment of FIGS. 10-15, however FIGS. 17-19 illustrate alternate embodiments of the resilient member 240, as described below. Additionally, in this embodiment, the engagement member 180 is located approximately at a midpoint between the heel and toe edges 223, 224 of the face member 220 and between the heel and toe edges 233, 234 of the rear member 230. In this location, the engagement member 280 and the joint 261 also approximately aligned laterally with the CG of the face member 220, the rear member 230, and/or the club head 201 as a whole. In other embodiments, the engagement member 280 may have a different orientation, structure, or location, as described below.

Figure 13:
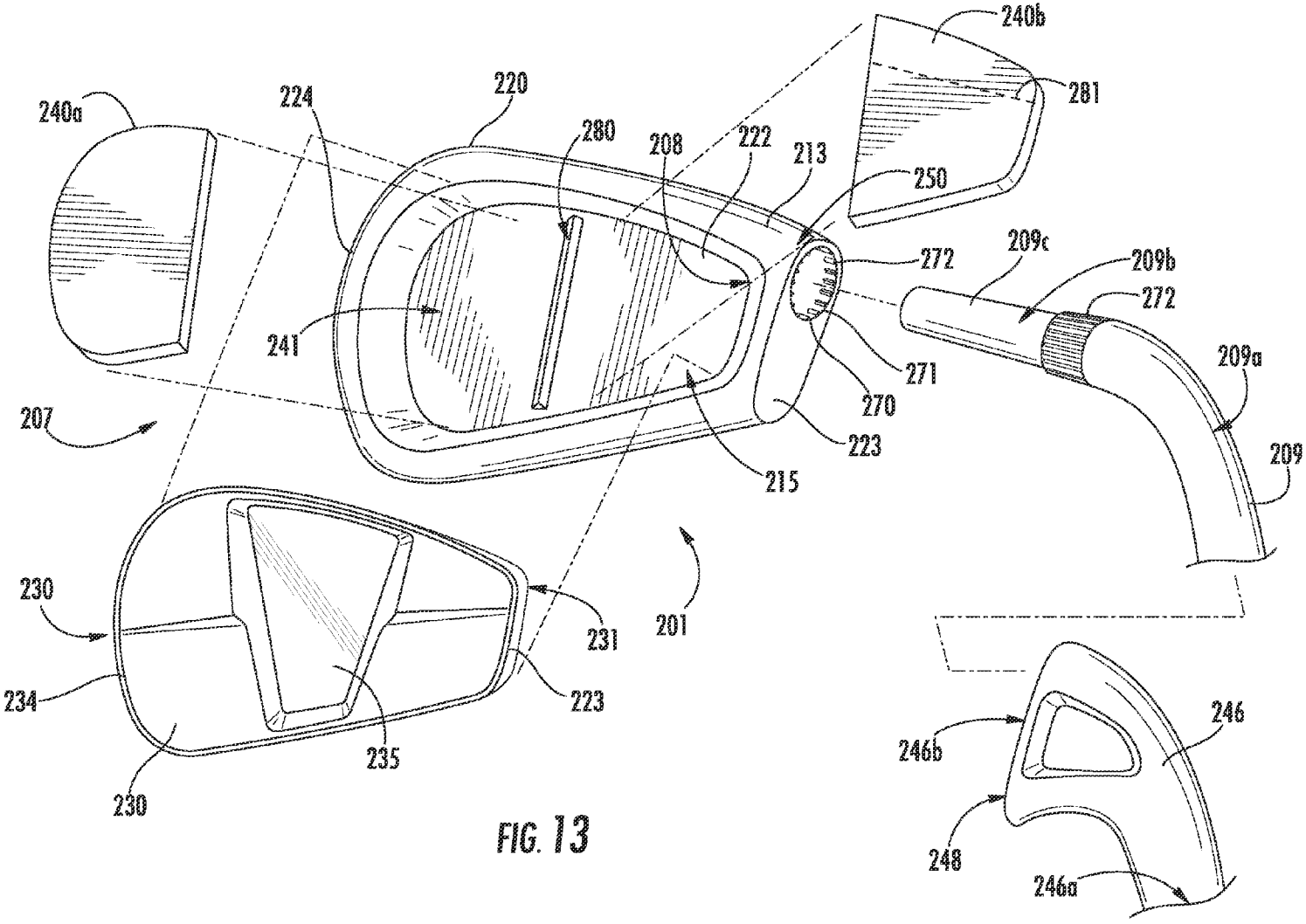
FIG. 13 is a rear exploded view of the head of the iron-type golf club shown in FIG. 10.
Figure 14:
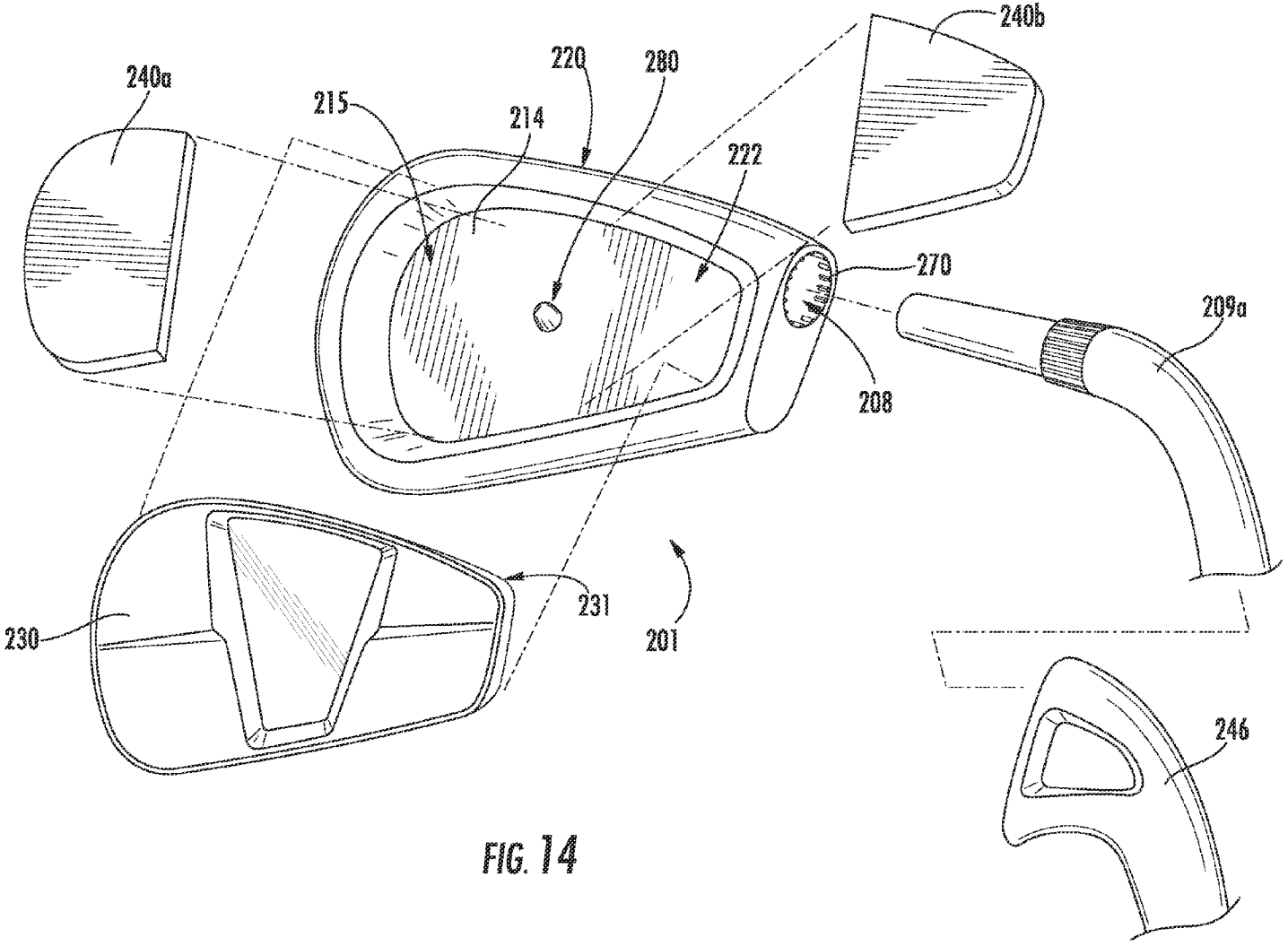
FIG. 14 is a rear exploded view of another illustrative embodiment of an iron-type golf club head according to aspects of the disclosure.
Figure 15:
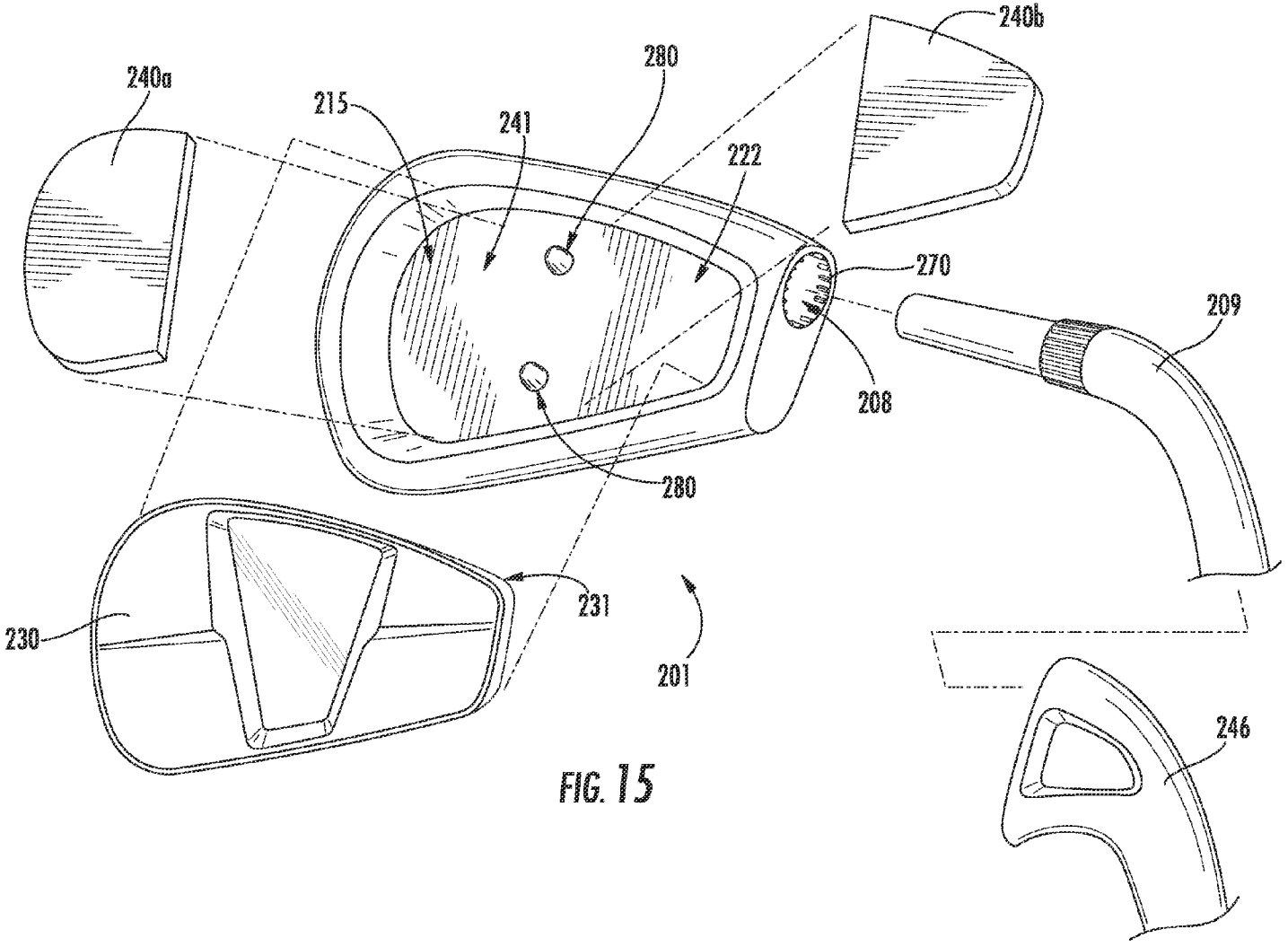
FIG. 15 is a rear exploded view of another illustrative embodiment of an iron-type golf club head according to aspects of the disclosure.

FIGS. 14-15 illustrate potential alternate embodiments of the engagement member 280 that may be used in connection with the club head 201 shown in FIGS. 10-13, and it is understood that any of the engagement members 280 described herein may be utilized with any embodiments of club heads 201 described herein. In the embodiment of FIG. 14, the engagement member 280 is in the form of a domed projection that is fixed to the rear surface 222 of the face member 220 and abuts the front surface 231 of the rear member 230. This engagement member 280 may be laterally aligned with the CG of the face member 220, the rear member 230, and/or the club head 201 as a whole, and may additionally or alternately be vertically aligned with the CG of one or more of these components, in a further embodiment. In the embodiment of FIG. 15, the head 201 includes two engagement members 280 in the form of two domed projections as described above. These engagement members 280 may be laterally aligned with the CG of the face member 220, the rear member 230, and/or the club head 201 as a whole, in one embodiment. Further configurations of engagement members 280 may be used, including engagement members that are fixed to the front surface 231 of the rear member 230 and abut the rear surface 222 of the face member 220, or engagement members that are embedded within the resilient member 240 and are fixed to neither the face member 220 nor the rear member 230. It is understood that the engagement members 280 in FIGS. 10-15 may be considered to define a joint 261 between the face member 220 and the rear member 230, in one embodiment.

The head 201 may further include a resilient member 240 positioned in a space 241 between the rear member 230 and the face member 220 and engaging both the front surface 231 of the rear member 230 and the rear surface 222 of the face member 220. FIG. 13 illustrates the club head 201 of FIGS. 10-13 having a resilient member 240 between the rear member 230 and the face member 220. The resilient member 240 may be connected to the face member 220 and/or the rear member 230 in any manner described herein, including by the use of adhesives or other bonding materials. The resilient member 240 in the embodiment of FIG. 13 has two sections or portions: a heel section or portion 240*a* and a toe section or portion 240*b*. In the embodiment illustrated, the heel and toe sections 240*a,b* are completely separate from each other and spaced by a gap 248 that provides room for the engagement member 280. However, in another embodiment, the heel and toe portions 240*a,b* may be connected, such as by one or more bridging members spanning the gap 248. As shown in FIG. 13, the heel and toe portions 240*a,b* of the resilient member 240 conform to the inner surfaces of the perimeter weighting member 213 defining the rear cavity 215 and substantially fill the portions of the rear cavity 215 proximate the heel 207*d* and toe 207*c*. The resilient members 240 in FIGS. 14-15 have a similar configuration to that shown in FIG. 13. The resilient member 240 may have further different configurations in other embodiments, including having more than two pieces. It is understood that the configuration of the resilient member 240 may be at least partially dictated by the configurations of the face member 220 and/or the rear member 230. The resilient material of the resilient member 240 may be made from any material described herein with respect to the resilient member 140 in FIGS. 1-6.

FIGS. 17-19 illustrate other embodiments of resilient members 240 that can be used in connection with the embodiments of FIGS. 10-15. For example, the resilient member 240 in FIG. 17 can be used in connection with the head 201 in FIGS. 10-13, and includes a gap 248 formed by a slot that is shaped and located to permit the engagement member 280 to engage both the face member 220 and the rear member 230 through the resilient member 240. The resilient member 240 in FIG. 18 can be used in connection with the head 201 in FIG. 14, and includes a gap 248 formed by a hole that is shaped and located to permit the engagement member 280 to engage both the face member 220 and the rear member 230 through the resilient member 240. The resilient member 240 in FIG. 19 can be used in connection with the head 201 in FIG. 15, and includes two gaps 248 formed by two holes that are shaped and located to permit the engagement members 280 to engage both the face member 220 and the rear member 230 through the resilient member 240. It is understood that any of the resilient members described herein may include a cut-out to provide room for the shaft engaging member 109, as shown by the broken lines 281 in FIG. 13.

Figure 22:
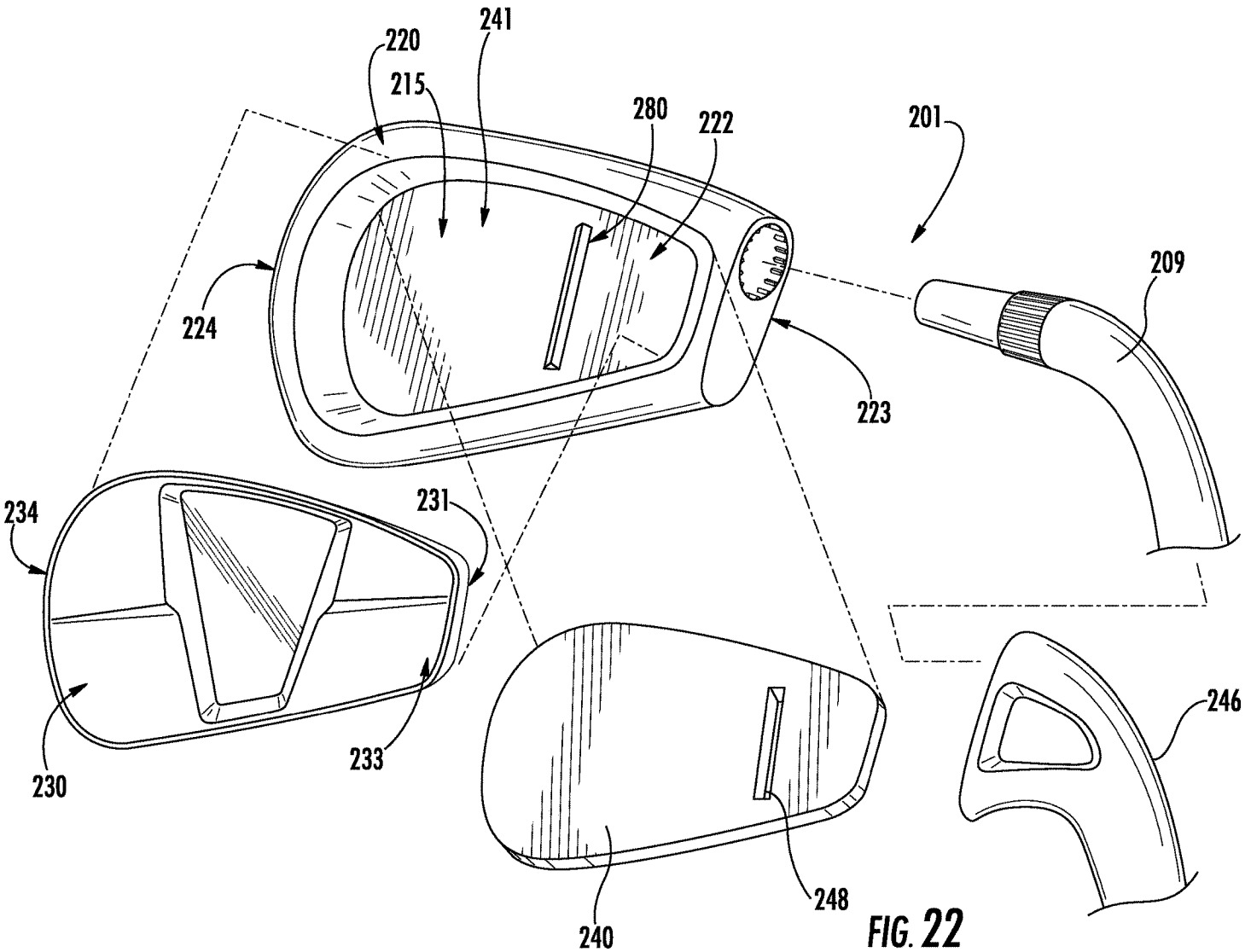
FIG. 22 is a rear exploded view of another illustrative embodiment of an iron-type golf club head according to aspects of the disclosure.

FIG. 22 illustrates another embodiment of a club head 201 that is similar in most ways to the club head of FIGS. 10-13. The difference in this embodiment is that the engagement member 280 is located closer to the heel edges 223, 233 than to the toe edges 224, 234 of the face member 220 and the rear member 230. In this configuration, the engagement member 280 provides for greater transfer of energy and/or momentum to the face member 220 upon impacts that occur close to the toe edge 224 of the face member 220. Toe impacts are a particularly common and problematic occurrence for users of iron-type golf clubs, as impacts near the toe tend to exert greater twisting moments on the shaft 203. In a further embodiment, the head 201 may have the engagement member 280 located closer to the toe edges 224, 234, to obtain a similar effect with respect to impacts near the heel edge 223 of the face member 220. The resilient member 240 in FIG. 22 is configured to provide a gap 248 that cooperates with the location and structure of this particular embodiment of the engagement member 280.

As described above, the engagement member(s) 280 form a joint 261 that permits energy and/or momentum to be transferred between the rear member 230 and the face member 220 during impact, including an off-center impact on the striking surface. It is understood that the rear member 230 may be retained in connection with the resilient material 240 and/or the face member 220 by various retaining structures. In one embodiment, the rear member 230 may be bonded (e.g., adhesively) to the resilient material 240, which is in turn bonded to the face member 220. In another embodiment, the head 101 may include connecting structure for this purpose, such as described above with respect to FIGS. 1-9, and this connecting structure may be a part of the engagement member 280 in one embodiment.

Figure 16:
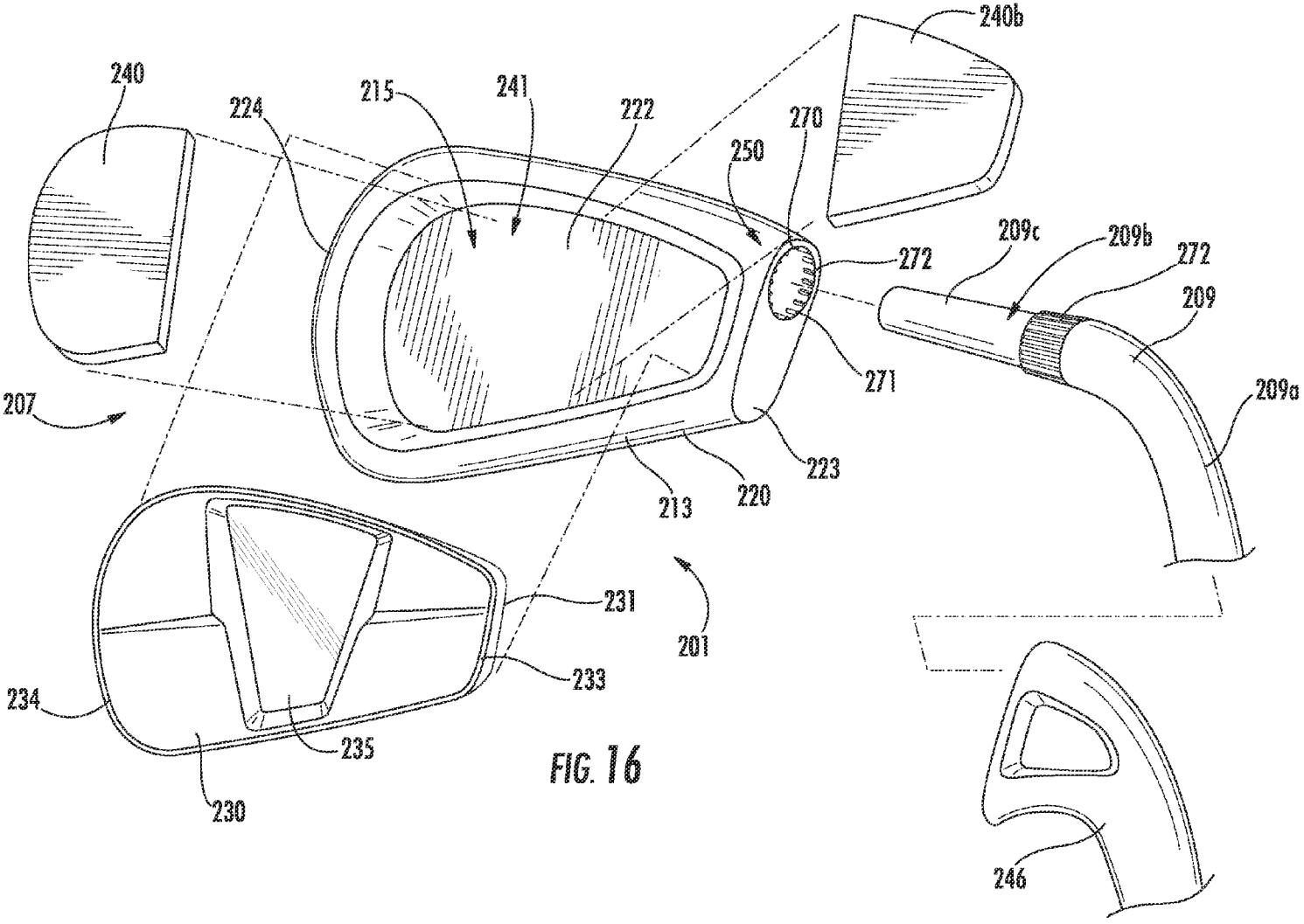
FIG. 16 is a rear exploded view of another illustrative embodiment of an iron-type golf club head according to aspects of the disclosure.

In another embodiment, as shown in FIG. 16, the resilient member 240 may form the only connection between the rear member 230 and the face member 220, and the rear member 230 may be considered to be suspended with respect to the face member 220 by the resilient member 240 in this configuration. The rear member 230 and the face member 220 have configurations similar to the same components of the embodiment of FIGS. 10-13, except without the engagement members forming the joint 261. In the embodiment illustrated in FIG. 16, the resilient member 240 is configured similarly to the resilient member 240 in FIG. 14, with separate heel and toe portions 240*a,b*. However, in another embodiment, the resilient member 240 may have a different configuration, such as being formed of a single piece, filling or substantially filling the entire rear cavity 215.

In the embodiment illustrated in FIGS. 10-13, the head 201 includes a shaft engaging member 209 connecting the shaft 203 to the body 207, which includes many features of the shaft engaging member 109 of FIGS. 1-6. Accordingly, for the sake of brevity, the shaft engaging member 209 is described herein generally with respect to its differences from the shaft engaging member 109 of FIGS. 1-6. It is understood that the shaft engaging member 209 may include any variations or features of the shaft engaging member 109 described herein. In general, the protrusion 209*c* and any other connecting portion of the shaft engaging member 209 may be positioned below the CG of the head 201, as described above.

The shaft engaging member 209 in FIGS. 10-13 has a first portion 209*a*, a second portion 209*b*, and a protrusion 209*c* engaging the connecting structure 250 of the club head body 207 and received within the body 207. The protrusion 209*c* has rotational locking structure in the form of teeth 272 extending around the entire periphery of the protrusion 209*c*, over a portion of the length of the protrusion 209*c*. The protrusion 209*c* has an enlarged portion 273, upon with the teeth 272 are positioned. In another embodiment, the teeth 272 may extend along the entire or substantially the entire length of the protrusion 209*c*, such as in the embodiment of FIGS. 1-6. The length of the protrusion 209*c* in FIGS. 10-13 is shorter than that of the protrusion 109*c* in FIGS. 1-6, however the protrusion 209*c* may have any length described above.

The head 201 in FIGS. 10-13 has connecting structure 250 for connection to the shaft engaging member 209, which may include rotational locking structure. As shown in FIGS. 10-13, the face member 220 has an opening 271 in the heel end 223, which is in communication with a passage 208 within the face member 220, as described above. The protrusion 209*c* of the shaft engaging member 209 is received in the passage 208 through the opening 271 to connect the shaft engaging member 209 to the body 207, as similarly described above with respect to FIGS. 1-6. The passage 208 may be in communication with the rear cavity 215 in one embodiment, such that the protrusion 209*c* extends through the passage and at least partially into the rear cavity 215. The passage 208 has an engaging surface 270 with teeth 272 proximate the opening 271, extending over at least a portion of the passage 208, which interlock with the teeth 272 of the protrusion 209*c* to form a rotational locking structure, as described above. The body 207 and/or the shaft engaging member 209 may have additional or alternate rotational locking structure in another embodiment. Once the protrusion 209*c* is received in the passage 208, the body 207 may be connected to the shaft engaging member 209 by any structure or technique described herein, including permanent connections (e.g., welding, brazing, adhesive, etc.) and removable/reconnectable structures. The body 207 and the shaft engaging member 209 may thereby be positioned in a plurality of different rotational positions relative to each other, as described elsewhere herein and shown in FIG. 21, and such a configuration may produce any of the advantages described herein. The rotational locking structure may provide for fixed incremental adjustment as described above with respect to FIGS. 1-9 and/or may also be used in connection with the sleeve 173 of FIG. 23.

The golf club head 201 of FIGS. 10-13 may also contain a shroud 246 that engages at least one of the body 207 and the shaft engaging member 209 and at least partially covers the shaft engaging member 209, the connecting structure 250 of the body 207, and/or the gap 216 between the first portion 209*a* of the shaft engaging member 209 and the heel end 207*d* of the body 207. The shroud 246 may receive at least a portion of the first portion 209*a* (i.e. the leg) and/or the second portion 209*b* of the shaft engaging member 209 to accomplish this function. The shroud 246 may be purely cosmetic in one embodiment, and may be configured to create the appearance of an integral hosel. In other embodiments, the shroud 246 may serve a structural or other functional purpose. In the embodiment of FIGS. 10-13, the shroud 246 receives and partially covers the first and second portions 209*a,b* of the shaft engaging member 209, and completely covers the heel end 207*d* and the opening 271 of the passage 208 of the body 207. Additionally, the shroud 246 in this embodiment extends across the gap 216 to engage both the body 207 and the first portion 209*a* of the shaft engaging member 209, and at least partially covers the gap 216. The shroud 246 in this embodiment has two end openings 246*a* and 246*b*. The first opening 246*a* receives the first portion 209*a* of the shaft engaging member 209 therethrough, and the second opening 246*b* allows the second portion 209*b* of the shaft engaging member 209 to extend through to connect to the body 207. The second opening 246*b* also engages and surrounds the flat surface at the heel end 207*d* of the body 207 in this embodiment. The shroud 246 as shown in FIGS. 10-13 has a flared end portion 248 around the second opening 246*b*, such that the second opening 246*b* is also flared. Further, the shroud 246 (or the flared end portion 248 thereof) may have surfaces that are substantially flush and/or contiguous with one or more surfaces of the golf club head body 207 around the heel end 207*d*, such as the top 207*a*, the sole 207*b*, the face 211, and/or the rear of the perimeter weighting member 213. The shroud 246 may be a shell made from plastic or other polymer material (including fiber reinforced polymers or other composites) in one embodiment, however it is understood that other materials may be used in other embodiments. It is further understood that the shroud 246 may have a different configuration in another embodiment.

A wide variety of overall club head constructions are possible without departing from this disclosure. For example, it is noted that the dimensions and/or other characteristics of the golf club heads 101 and 201 according to examples of this disclosure may vary significantly without departing from the disclosure. For example, the above described features and configurations may be incorporated into any iron-type club heads including, for example: wedges (e.g., pitching wedges, lob wedges, gap wedges, sand wedges, etc.), iron-type hybrid clubs, driving irons, 0 through 10 irons, etc. While iron-type golf clubs and iron-type golf club heads have been described in detail above, other aspects of this disclosure may be used in connection with wood-type golf club heads, hybrid-type golf club heads, putter heads, and other types of golf club heads or other ball striking devices, including golf clubs incorporating such heads.

The various embodiments and configurations described herein produce multiple advantages over existing golf clubs and other ball striking devices. For example, the use of rotational locking structure can simplify manufacturing by reducing the number of different parts required to produce a full set of club heads, and can thereby reduce costs and increase efficiency. In other words, a single shaft engaging member and club head can be used to produce multiple different iron clubs having different loft angles, so that each different club does not require its own specific club head part. As another example, the use of releasable rotational locking structure permits for customization of a club head by a user, retailer, custom fitter, etc. As a further example, the transfer of energy and/or momentum transfer from the rear member to the face member can assist in resisting deflection of the face upon impact of the ball on the striking surface, particularly on off-center hits. This, in turn, can create greater energy and/or momentum transfer to the ball, straighter ball flight, and/or less undesirable side-spin. As yet another example, the use of rotational locking structure can permit users to adjust the loft angles of some of his/her clubs to provide larger or smaller "gaps" in ball flight distance between sequential clubs. This can be particularly beneficial for long irons, where many golfers do not obtain great variation in distance. Still other benefits and advantages are recognizable to those skilled in the art.

It is understood that any embodiments shown and described herein may incorporate one or more features shown and/or described herein with respect to any other embodiment. For example, the embodiments of FIGS. 1-9 may include any features shown and/or described herein with respect to FIGS. 10-22, and vice versa. In other words, the embodiments of FIGS. 1-9 may contain engagement members 280 as described herein and/or shown in FIGS. 10-22, or the embodiments of FIGS. 10-22 may include connection members as described herein and/or shown in FIGS. 1-9. A wide variety of overall club head constructions are possible without departing from this disclosure. For example, it is noted that the dimensions and/or other characteristics of the golf club heads according to examples of this disclosure may vary significantly without departing from the disclosure.

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 23 may be used individually and/or in any combination or subcombination without departing from this disclosure.

What is claimed is:

1. A golf club head comprising:

an iron-type golf club head body having connecting structure, the golf club head body comprising:

a face member including a face having a striking surface configured for striking a ball and a rear side opposite the striking surface of the face, the face member having a heel edge and a toe edge;

a rear member joined to the rear side of the face member, the rear member having a heel edge and a toe edge; and a first connection member connecting the rear side of the face member to the rear member at a connection point located toward a center of the face from the heel edge and the toe edge of the face member and located toward a center of the rear member from the heel edge and the toe edge of the rear member, wherein the face member is spaced from the rear member between the first connection member and the heel edge of the face member and between the first connection member and the toe edge of the face member, and wherein the connection point comprises a joint that permits the rear member to transfer momentum to the face member upon an impact of the ball on the striking surface; and a shaft engaging member engaged with the connecting structure of the golf club head body, wherein the shaft engaging member is configured to be engaged with a golf club shaft to connect the shaft to the golf club head body, wherein the connecting structure comprises a passage extending into the golf club head body from a heel side of the golf club head body, wherein the face member and the rear member combine to define the passage, and wherein the shaft engaging member is received in the passage to engage the connecting structure.

2. The golf club head of claim 1, wherein the first connection member comprises a pin mounted on one of the face member and the rear member that engages a first complementary connection member on the other of the face member and the rear member to connect the face member to the rear member.

3. The golf club head of claim 2, wherein the joint further comprises a second complementary connection member on the other of the face member and the rear member, wherein the pin engages the second complementary connection member to connect the face member to the rear member.

4. The golf club head of claim 1, further comprising a resilient member separating the rear member from the rear side of the face member, wherein the resilient member engages the rear member and the rear side of the face member and is configured to transfer momentum between the face member and the rear member.

5. The golf club head of claim 1, wherein the connection point is located approximately equidistant from the heel edge and the toe edge of the face member and approximately equidistant from the heel edge and the toe edge of the rear member.

6. The golf club head of claim 1, further comprising a resilient member separating the rear member from the rear side of the face member, wherein the resilient member engages the rear member and the rear side of the face member and is configured to transfer momentum between the face member and the rear member.

7. The golf club head of claim 1, wherein the connecting structure and the shaft engaging member have complementary rotational locking structure to rotationally lock the shaft engaging member with the connecting structure, and wherein the rotational locking structure is adjustable, such that the shaft engaging member is configured to be engaged with the connecting structure in at least a first rotational position and a second rotational position with respect to the golf club head body, wherein a loft angle of the golf club head in the first position is different from the loft angle of the golf club head in the second position.

8. The golf club head of claim 1, wherein the shaft engaging member comprises a protrusion and an arm extending upward and away from the protrusion, wherein the shaft engaging member engages the connecting structure of the golf club head body, such that the protrusion is at least partially received within the passage and extends horizontally into the golf club head body, and the arm is at least partially exposed and extends upward and away from the golf club head body, and wherein the protrusion is located completely below a center of gravity of the golf club head body.

9. A golf club head comprising:

an iron-type golf club head body having connecting structure, the golf club head body comprising:

a face member including a face having a striking surface configured for striking a ball and a rear side opposite the striking surface of the face, the face member having a heel edge and a toe edge;

a rear member joined to the rear side of the face member, the rear member having a heel edge and a toe edge; and a first connection member connecting the rear side of the face member to the rear member at a connection point located toward a center of the face from the heel edge and the toe edge of the face member and located toward a center of the rear member from the heel edge and the toe edge of the rear member, wherein the face member is spaced from the rear member between the first connection member and the heel edge of the face member and between the first connection member and the toe edge of the face member; and a shaft engaging member engaged with the connecting structure of the golf club head body, wherein the shaft engaging member is configured to be engaged with a golf club shaft to connect the shaft to the golf club head body; and wherein the connecting structure and the shaft engaging member have complementary rotational locking structure to rotationally lock the shaft engaging member with the connecting structure, and wherein the rotational locking structure is adjustable, such that the shaft engaging member is configured to be engaged with the connecting structure in at least a first rotational position and a second rotational position with respect to the golf club head body, wherein a loft angle of the golf club head in the first position is different from the loft angle of the golf club head in the second position, and wherein the connecting structure comprises a passage extending into the golf club head body from a heel side of the golf club head body, wherein the face member and the rear member combine to define the passage, and wherein the shaft engaging member is received in the passage to engage the connecting structure.

10. The golf club head of claim 9, wherein the connection point comprises a joint that permits the rear member to transfer momentum to the face member upon an impact of the ball on the striking surface.

11. The golf club head of claim 10, wherein the first connection member comprises a pin mounted on one of the face member and the rear member that engages a first complementary connection member on the other of the face member and the rear member to connect the face member to the rear member.

12. The golf club head of claim 11, wherein the joint further comprises a second complementary connection member on the other of the face member and the rear member, wherein the pin engages the second complementary connection member to connect the face member to the rear member.

13. The golf club head of claim 10, further comprising a resilient member separating the rear member from the rear side of the face member, wherein the resilient member engages the rear member and the rear side of the face member and is configured to transfer momentum between the face member and the rear member.

14. The golf club head of claim 9, wherein the connection point is located approximately equidistant from the heel edge and the toe edge of the face member and approximately equidistant from the heel edge and the toe edge of the rear member.

15. The golf club head of claim 9, further comprising a resilient member separating the rear member from the rear side of the face member, wherein the resilient member engages the rear member and the rear side of the face member and is configured to transfer momentum between the face member and the rear member.

16. The golf club head of claim 9, wherein the shaft engaging member is engaged with the connecting structure at a location completely below a center of gravity of the golf club head body.

17. A golf club head comprising:

an iron-type golf club head body comprising:

a face member including a face having a striking surface configured for striking a ball and a rear side opposite the striking surface of the face, the face member having a heel edge and a toe edge, and wherein the face member has a first engaging surface;

a rear member joined to the rear side of the face member, the rear member having a heel edge and a toe edge, wherein the rear member has a second engaging surface;

a first connection member connecting the rear side of the face member to the rear member at a connection point located toward a center of the face from the heel edge and the toe edge of the face member and located toward a center of the rear member from the heel edge and the toe edge of the rear member, wherein the face member is spaced from the rear member between the first connection member and the heel edge of the face member and between the first connection member and the toe edge of the face member, and wherein the first connection member comprises a pin on the rear side of the face member that is received in a receiver on the rear member to form a joint that permits the rear member to transfer momentum to the face member upon an impact of the ball on the striking surface; and a resilient member separating the rear member from the rear side of the face member, wherein the resilient member engages the rear member and the rear side of the face member and is configured to transfer momentum between the face member and the rear member;

wherein the first engaging surface and the second engaging surface combine to define a passage extending into the golf club head body and forming at least a portion of a connecting structure of the golf club head body; and a shaft engaging member comprising a horizontal protrusion and an arm extending upward and away from the protrusion, wherein the shaft engaging member is engaged with the connecting structure of the golf club head body such that the protrusion is received in the passage and the arm extends upwardly and away from the golf club head body, wherein the arm of the shaft engaging member is configured to be engaged with a golf club shaft to connect the shaft to the golf club head body; and wherein the connecting structure and the shaft engaging member have complementary rotational locking structure comprising a plurality of complementary, interlocking gear teeth on the protrusion and the first and second engaging surfaces defining the passage to rotationally lock the shaft engaging member with the connecting structure, and wherein the rotational locking structure is adjustable, such that the shaft engaging member is configured to be engaged with the connecting structure in at least a first rotational position and a second rotational position with respect to the golf club head body, wherein a loft angle of the golf club head in the first position is different from the loft angle of the golf club head in the second position.

18. A golf club head comprising:

an iron-type golf club head body having connecting structure, the golf club head body comprising:

a face member including a face having a striking surface configured for striking a ball and a rear side opposite the striking surface of the face;

a rear member joined to the rear side of the face member and having a front side confronting the rear side of the face member; and a resilient member positioned between the face member and the rear member and separating the front side of the rear member from the rear side of the face member, wherein the resilient member engages the front side of the rear member and the rear side of the face member; and a shaft engaging member engaged with the connecting structure of the golf club head body, wherein the shaft engaging member is configured to be engaged with a golf club shaft to connect the shaft to the golf club head body, wherein the connecting structure comprises a passage extending into the golf club head body from a heel side of the golf club head body, wherein the face member and the rear member combine to define the passage, and wherein the shaft engaging member is received in the passage to engage the connecting structure, and wherein the face member and the rear member each have engaging surfaces that combine to define the passage, wherein the connecting structure and the shaft engaging member have complementary rotational locking structure comprising a plurality of complementary, interlocking gear teeth, and wherein the engaging surfaces of the face member and rear member at least partially form the rotational locking structure of the connecting structure.

19. The golf club head of claim 18, wherein the shaft engaging member is engaged with the connecting structure at a location completely below a center of gravity of the golf club head body.

20. The golf club head of claim 18, further comprising a first connection member connecting the rear side of the face member to the front side of the rear member at a connection point located toward a center of the face from a heel edge and a toe edge of the face member and located toward a center of the rear member from a heel edge and a toe edge of the rear member, wherein the face member is spaced from the rear member between the first connection member and the heel edge of the face member and between the first connection member and the toe edge of the face member.

21. The golf club head of claim 1, wherein the shaft engaging member is engaged with the connecting structure at a location completely below a center of gravity of the golf club head body.

22. The golf club head of claim 1, wherein the face member and the rear member each have engaging surfaces that combine to define the passage, wherein the connecting structure and the shaft engaging member have complementary rotational locking structure comprising a plurality of complementary, interlocking gear teeth, and wherein the engaging surfaces of the face member and rear member at least partially form the rotational locking structure of the connecting structure.

23. The golf club head of claim 9, wherein the face member and the rear member each have engaging surfaces that combine to define the passage, and wherein the engaging surfaces of the face member and rear member at least partially form the rotational locking structure of the connecting structure.

24. A golf club head comprising:

an iron-type golf club head body having connecting structure, the golf club head body comprising:

a face member including a face having a striking surface configured for striking a ball and a rear side opposite the striking surface of the face, the face member having a heel edge and a toe edge;

a rear member joined to the rear side of the face member, the rear member having a heel edge and a toe edge; and a first connection member connecting the rear side of the face member to the rear member at a connection point located toward a center of the face from the heel edge and the toe edge of the face member and located toward a center of the rear member from the heel edge and the toe edge of the rear member, wherein the face member is spaced from the rear member between the first connection member and the heel edge of the face member and between the first connection member and the toe edge of the face member; and a shaft engaging member engaged with the connecting structure of the golf club head body, wherein the shaft engaging member is configured to be engaged with a golf club shaft to connect the shaft to the golf club head body, wherein the connecting structure comprises a passage extending into the golf club head body from a heel side of the golf club head body, wherein the face member and the rear member combine to define the passage, and wherein the shaft engaging member is received in the passage to engage the connecting structure, and wherein the connecting structure and the shaft engaging member have complementary rotational locking structure to rotationally lock the shaft engaging member with the connecting structure, and wherein the rotational locking structure is adjustable, such that the shaft engaging member is configured to be engaged with the connecting structure in at least a first rotational position and a second rotational position with respect to the golf club head body, wherein a loft angle of the golf club head in the first position is different from the loft angle of the golf club head in the second position.

25. A golf club head comprising:

an iron-type golf club head body having connecting structure, the golf club head body comprising:

a face member including a face having a striking surface configured for striking a ball and a rear side opposite the striking surface of the face, the face member having a heel edge and a toe edge;

a rear member joined to the rear side of the face member, the rear member having a heel edge and a toe edge; and a first connection member connecting the rear side of the face member to the rear member at a connection point located toward a center of the face from the heel edge and the toe edge of the face member and located toward a center of the rear member from the heel edge and the toe edge of the rear member, wherein the face member is spaced from the rear member between the first connection member and the heel edge of the face member and between the first connection member and the toe edge of the face member; and a shaft engaging member engaged with the connecting structure of the golf club head body, wherein the shaft engaging member is configured to be engaged with a golf club shaft to connect the shaft to the golf club head body, wherein the connecting structure comprises a passage extending into the golf club head body from a heel side of the golf club head body, wherein the face member and the rear member combine to define the passage, and wherein the shaft engaging member is received in the passage to engage the connecting structure, and wherein the face member and the rear member each have engaging surfaces that combine to define the passage, wherein the connecting structure and the shaft engaging member have complementary rotational locking structure comprising a plurality of complementary, interlocking gear teeth, and wherein the engaging surfaces of the face member and rear member at least partially form the rotational locking structure of the connecting structure.

* * * * *